US012736249B2

(12) United States Patent
Tanno

(10) Patent No.: US 12,736,249 B2
(45) Date of Patent: Sep. 15, 2026

(54) AIR CONDITIONING SYSTEM, AIR CONDITIONING APPARATUS, AND CONTROL METHOD

(71) Applicant: FUJITSU GENERAL LIMITED, Kanagawa (JP)

(72) Inventor: Tetsunori Tanno, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 122 days.

(21) Appl. No.: 18/837,701

(22) PCT Filed: Mar. 6, 2023

(86) PCT No.: PCT/JP2023/008348
§ 371 (c)(1),
(2) Date: Aug. 12, 2024

(87) PCT Pub. No.: WO2023/181885
PCT Pub. Date: Sep. 28, 2023

(65) Prior Publication Data

US 2025/0137679 A1 May 1, 2025

(30) Foreign Application Priority Data

Mar. 24, 2022 (JP) ..... 2022-048114

(51) Int. Cl.
*F24F 11/86* (2018.01)
*F24F 11/50* (2018.01)
(Continued)

(52) U.S. Cl.
CPC ..... *F24F 11/86* (2018.01); *F24F 11/50* (2018.01); *F24F 2110/10* (2018.01); *F24F 2140/00* (2018.01)

(58) Field of Classification Search
CPC .. F24F 11/86; F24F 11/50; F24F 11/61; F24F 11/64; F24F 11/30; F24F 2110/10;
(Continued)

(56) References Cited

U.S. PATENT DOCUMENTS

2015/0204592 A1 7/2015 Iwasaki et al.
2016/0018124 A1* 1/2016 Yamamoto ..... G05B 13/026 700/276

(Continued)

FOREIGN PATENT DOCUMENTS

EP 2955463 A1 12/2013
GB 2542083 A 3/2017

(Continued)

OTHER PUBLICATIONS

International Search Report issued in International Patent Application No. PCT/JP2023/008348, dated May 23, 2023, along with an English translation thereof.

(Continued)

*Primary Examiner* — Marc E Norman
(74) *Attorney, Agent, or Firm* — Greenblum & Bernstein, P.L.C.

(57) ABSTRACT

An air conditioning system includes an outdoor unit, multiple indoor units, a control device and a server device. The server device includes a first predicting unit that predicts room temperature of an air-conditioned space, by using a plurality of operation state amounts relating to air conditioning operation; and a second predicting unit that predicts a point of time when each indoor unit out of the indoor units is switched to thermo-ON and a point of time when it is switched to thermo-OFF, by using the room temperature predicted and set temperature that is a target temperature of the air conditioning operation. The control device includes a control unit that controls driving of the compressor accord- (Continued)

ing to the point of time when each of the indoor unit is switched to the thermo-ON or the thermo-OFF, by using a prediction result of the second predicting unit.

17 Claims, 15 Drawing Sheets

(51) Int. Cl.
*F24F 110/10* (2018.01)
*F24F 140/00* (2018.01)

(58) Field of Classification Search
CPC ..... F24F 2140/00; F25B 2600/01; F25B 2600/0251; F25B 2600/23
See application file for complete search history.

(56) References Cited

U.S. PATENT DOCUMENTS

2018/0195752 A1* 7/2018 Sasaki ..... F24F 11/64
2019/0212026 A1* 7/2019 Kim ..... G05B 13/048
2020/0393181 A1* 12/2020 Yang ..... F24F 11/64
2021/0254851 A1* 8/2021 Taguchi ..... G05B 13/0265
2023/0089866 A1* 3/2023 Suzumura ..... F24F 11/46 236/49.3

FOREIGN PATENT DOCUMENTS

| | | | |
|---|---|---|---|
| JP | H02-154945 | A | 6/1990 |
| JP | 2013-221637 | A | 10/2013 |
| JP | 2013213613 | A | 10/2013 |
| JP | WO2018199167 | A1 | 11/2018 |
| JP | 2020-067270 | A | 4/2020 |
| JP | 2021156513 | A | 10/2021 |
| WO | WO 2014/013528 | A1 | 1/2014 |
| WO | WO 2014/115247 | A1 | 7/2014 |
| WO | WO 2022/044325 | A1 | 3/2022 |

OTHER PUBLICATIONS

Written Opinion issued in International Patent Application No. PCT/JP2023/008348, dated May 23, 2023.
Supplementary European Search Report in counterpart EP Application No. 23774484.2, mailed on Feb. 17, 2026.

* cited by examiner

FIG.2

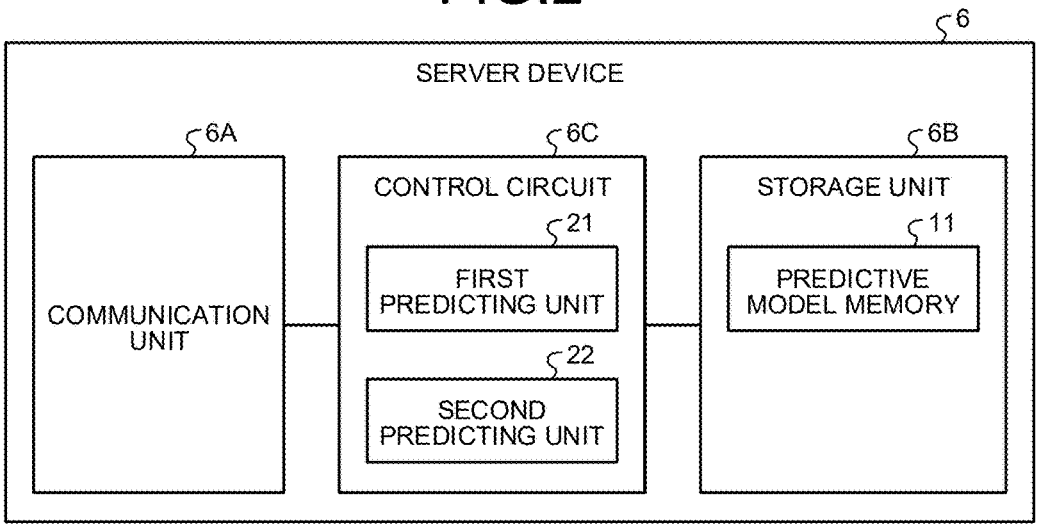

FIG.3

| ITEM | THERMO-OFF | THERMO-ON |
|---|---|---|
| ALGORITHM | Lasso REGRESSION | Lasso REGRESSION |
| TARGET VARIATION | VARIATION AMOUNT PER SECOND IN ROOM TEMPERATURE | VARIATION AMOUNT PER SECOND IN ROOM TEMPERATURE |
| FEATURE AMOUNT | SET TEMPERATURE, ROOM TEMPERATURE, OUTDOOR AIR TEMPERATURE,<br>OUTDOOR AIR TEMPERATURE 1 HOUR AGO,<br>OUTDOOR AIR TEMPERATURE 2 HOURS AGO,<br>⋮<br>OUTDOOR AIR TEMPERATURE 20 HOURS AGO | SET TEMPERATURE, ROOM TEMPERATURE, OUTDOOR AIR TEMPERATURE,<br>OUTDOOR AIR TEMPERATURE 1 HOUR AGO,<br>OUTDOOR AIR TEMPERATURE 2 HOURS AGO,<br>⋮<br>OUTDOOR AIR TEMPERATURE 20 HOURS AGO<br>INDOOR UNIT SENSOR<br>FAN CONTROL<br>OPENING DEGREE OF INDOOR EXPANSION VALVE<br>VERTICAL LOUVER OPERATION<br>HORIZONTAL LOUVER OPERATION<br>OUTDOOR UNIT SENSOR<br>FAN ROTATION SPEED<br>DISCHARGE PIPE PRESSURE<br>LIQUID PIPE PRESSURE<br>SUCTION PIPE PRESSURE<br>OPENING DEGREE OF OUTDOOR EXPANSION VALVE<br>COMPRESSOR ROTATION SPEED<br>INVERTER CURRENT VALUE<br>INVERTER VOLTAGE<br>HIGH-PRESSURE GAS SATURATION TEMPERATURE<br>LOW-PRESSURE GAS SATURATION TEMPERATURE<br>HIGH-PRESSURE LIQUID SATURATION TEMPERATURE<br>LOW-PRESSURE LIQUID SATURATION TEMPERATURE |

AIR CONDITIONING SYSTEM, AIR CONDITIONING APPARATUS, AND CONTROL METHOD

FIELD

The present invention relates to an air conditioning system, an air conditioning apparatus, and a control method.

BACKGROUND

An air conditioning apparatus includes an outdoor unit equipped with an outdoor refrigerant circuit and multiple indoor units, each equipped with an indoor refrigerant circuit connected to the outdoor unit via refrigerant piping. The air conditioning apparatus controls driving of a compressor in the outdoor refrigerant circuit according to an air conditioning performance requested by each indoor unit. Each indoor unit in the air conditioning apparatus includes a room temperature sensor, and when the room temperature of the air-conditioned space detected by the room temperature sensor reaches the vicinity of a set temperature, which is the target temperature for air conditioning operation, (for example, temperature within ±0.5° C. of the set temperature), it becomes a thermo-OFF state in which the air conditioning operation of the indoor unit is suspended. Until the room temperature reaches the vicinity of the set temperature, it is in a thermo-ON state in which the air conditioning operation of the indoor unit is continued.

CITATION LIST

Patent Literature

Patent Literature 1: Japanese Laid-open Patent Publication No. 02-154945

SUMMARY

Technical Problem

In the air conditioning apparatus as described above, if all the indoor units are in the thermo-OFF state, the compressor in the outdoor refrigerant circuit is stopped. On the other hand, if even one of the indoor units is in the thermo-ON state, it becomes necessary to drive the compressor.

Furthermore, in the air conditioning apparatus, for example, if the air conditioning load in the space in which the air conditioning apparatus performs air conditioning (hereafter, it may be referred to as air-conditioned space) is smaller than the exhibited minimum air conditioning capacity, the compressor is driven and quickly brings the room temperature to the vicinity of the set temperature, turning all of the indoor units into the thermo-OFF state, to stop the compressor. Subsequently, in the air conditioning apparatus, when the room temperature rises (during cooling operation) or falls (during heating operation) and the room temperature deviates from the vicinity of the set temperature, any of the indoor units turns into the thermo-ON state, causing the compressor to restart. Thereafter, the room temperature again reaches the vicinity of the set temperature in short time, causing the compressor to stop. Thus, the stopping and restarting of the compressor are repeated.

As described, during the air conditioning operation of the air conditioning apparatus in an air-conditioned space with a small air conditioning load, the switching between the thermo-ON and the thermo-OFF frequently occurs, and stopping and restarting of the compressor frequently occurs. When the compressor is restarted, it consumes a significant amount of power. Therefore, there has been a problem that frequent stopping and restarting of the compressor leads to increased power consumption.

To reduce the power consumption as explained above that occurs when air conditioning is performed in an air-conditioned space with a small air conditioning load, it can be considered to keep the compressor running at a low speed without stopping and restarting the compressor. However, when the air conditioning load in the air-conditioned space is small, even running the compressor at a low speed may cause the room temperature to deviate from the set temperature, and it can reduce user comfort.

In view of the above problems, in one aspect, the present invention is aimed to provide an air conditioning system and the like that are capable of ensuring user comfort while reducing power consumption associated with air conditioning operation by reducing the number of times of stopping and restarting of a compressor.

Solution to Problem

According to an aspect of an embodiment, the air conditioning system includes an outdoor unit that includes a compressor, a plurality of indoor units that are connected to the outdoor unit through a refrigerant pipe, a control device that controls the outdoor unit and the indoor units, and a server device that is capable of communicating with the control device. The server device includes a first predictor and a second predictor. The first predictor predicts room temperature of an air-conditioned space in which the indoor units are installed, by using a plurality of operation state amounts relating to air conditioning operation. The second predictor predicts a point of time when each indoor unit out of the indoor units is switched to thermo-ON and a point of time when it is switched to thermo-OFF, by using the room temperature predicted by the first predictor and set temperature that is a target temperature of the air conditioning operation. The control device includes a controller that controls driving of the compressor according to the point of time when each of the indoor unit is switched to the thermo-ON or the thermo-OFF, by using a prediction result of the second predictor.

Advantageous Effects of Invention

In one aspect, it is possible to ensure user comfort while reducing power consumption associated with air conditioning operation by reducing the number of times of stopping and restarting of driving of a compressor.

BRIEF DESCRIPTION OF DRAWINGS

FIG. 2 is a block diagram illustrating an example of a configuration of a server device.

FIG. 3 is an explanatory diagram illustrating an example of a feature amount of a predictive model.

DESCRIPTION OF EMBODIMENTS

Hereinafter, embodiments of an air conditioning system and the like disclosed in the present application will be explained in detail based on the drawings. The embodiments are not intended to limit the disclosed technique. Moreover, the respective embodiments described below may be appropriately modified within a range not causing contradiction.

First Embodiment

Configuration of Air Conditioning System

Figure 1:
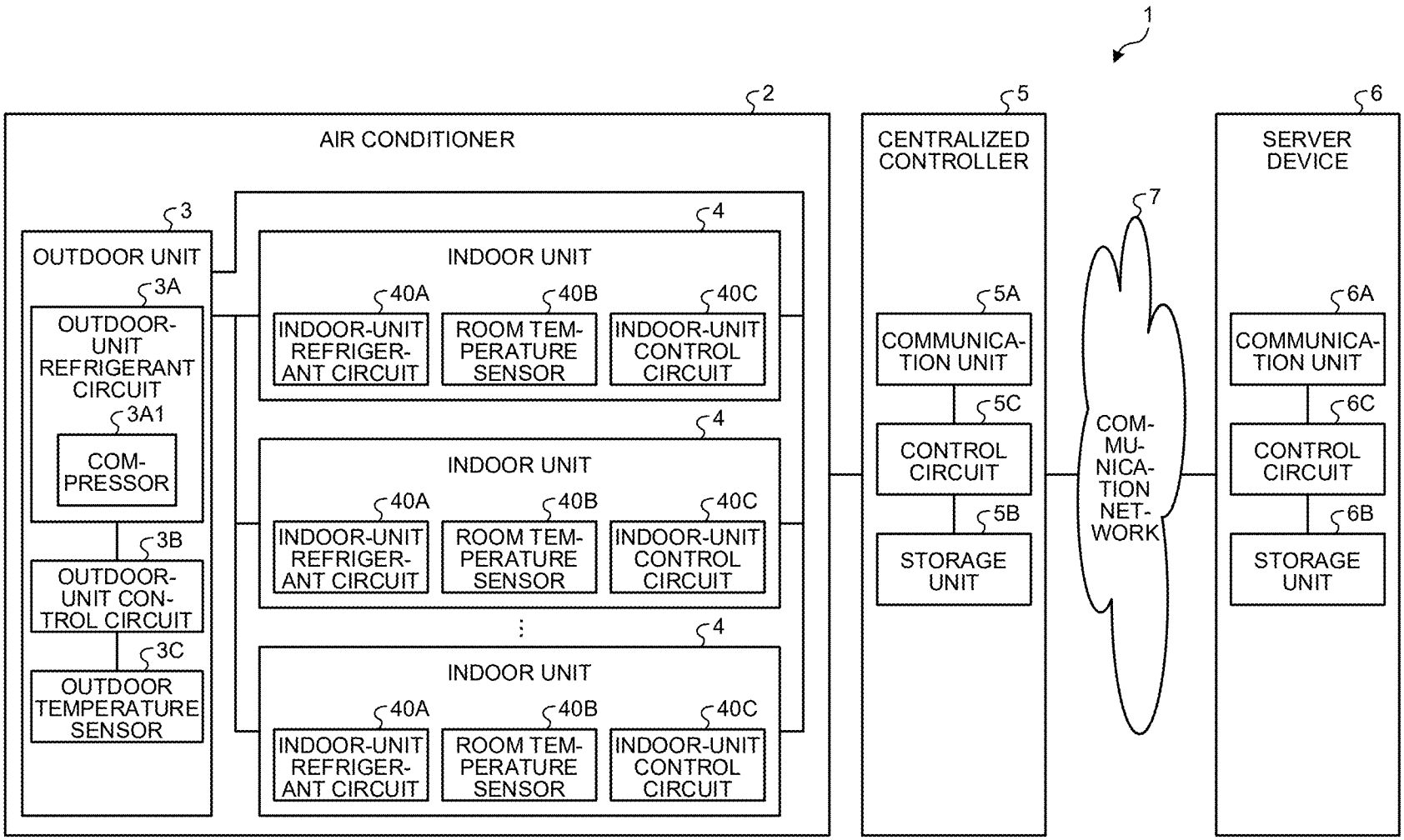
FIG. 1 is an explanatory diagram illustrating an example of a configuration of an air conditioning system according to a first embodiment.

FIG. 1 is an explanatory diagram illustrating an example of a configuration of an air conditioning system 1 according to a first embodiment. An air conditioning system 1 illustrated in FIG. 1 includes an air conditioner 2, a centralized controller 5, and a server device 6. The air conditioner 2 includes one unit of outdoor unit 3 and N units of indoor unit 4. The server device 5 performs communications with the centralized controller 5 through a communication network 7, and provides various kinds of services to the air conditioner 2 through the centralized controller 5.

The outdoor unit 3 in the air conditioner 2 are connected in parallel to each of the indoor units 4, for example, through a liquid pipe and a gas pipe. The outdoor unit 3 and indoor unit 4 are connected through a refrigerant piping, such as a liquid pipe and a gas pipe, thereby forming a refrigerant circuit of the air conditioner 2. The indoor unit 4 is installed in each indoor space, and cools or heats the indoor space.

The outdoor unit 3 includes an outdoor-unit refrigerant circuit 3A, an outdoor-unit control circuit 3B, and an outdoor temperature sensor 3C. The outdoor-unit refrigerant circuit 3A circulates refrigerant, for example, by using a compressor 3A1, to supply to each of the indoor units 4. The outdoor-unit control circuit 3B performs overall control of the outdoor unit 3 including driving control of the compressor 3A1. The outdoor temperature sensor 3C is a sensor to detect an outdoor temperature of the outdoor unit 3.

Furthermore, each of the indoor units 4 includes an indoor-unit refrigerant circuit 40A, an room temperature sensor 40B, and an indoor-unit control circuit 40C. The indoor-unit refrigerant circuit 40A includes a heat exchanger or the like that performs heat exchange with respect to refrigerant from the outdoor unit 3, and adjusts the room temperature in the air-conditioned space with the refrigerant passing through the heat exchanger. The room temperature sensor 40B is a detector that detect room temperature in an air-conditioned space in which the indoor unit 4 is installed. The indoor-unit control circuit 40C overall controls the indoor unit 4.

The indoor-unit control circuit 40C has a function of stopping cooling operation temporarily, for example, when set the room temperature reaches set temperature during the cooling operation. The set temperature is a target temperature of air conditioning operation of the indoor unit 4 set to the indoor unit 4 by a user. The indoor-unit control circuit 40C switches to the thermo-ON to perform cooling operation of the indoor unit 4, for example, when the room temperature exceeds thermo-ON temperature (set temperature+0.5° C.) during the cooling operation. The indoor-unit control circuit 40C continues the thermo-ON until the room temperature reaches thermo-OFF temperature (set temperature−0.5° C.) during the thermo-ON period. Furthermore, the indoor-unit control circuit 40C switches to the thermo-OFF to suspend the cooling operation of the indoor unit 4 when the room temperature reaches the thermo-OFF temperature.

The outdoor unit 3 continues driving of the compressor 3A1 in the outdoor-unit refrigerant circuit 3A when either one of the indoor units 4 out of the N units of the indoor units 4 is in the thermo-ON, and stops the driving of the compressor 3A1 when all of the indoor units 4 are in the thermo-OFF.

Configuration of Server Device

FIG. 2 is a block diagram illustrating an example of a configuration of the server device 6. The server device 6 illustrated in FIG. 2 includes a communication unit 6A, a storage unit 6B, and a control circuit 6C. The communication unit 6A communicates with the centralized controller 5 through the communication network 7. The control circuit 6C overall controls the server device 6. The storage unit 6B stores various kinds of information.

The storage unit 6B includes a predictive model memory 11. The predictive model memory 11 stores a predictive model to predict a thermo-ON time and a thermo-Off time that are points of time of the thermo-ON/OFF of the respective indoor units 4 described later.

The control circuit 6C includes a first predicting unit 21 and a second predicting unit 22. The first predicting unit 21 predicts room temperature, for example, each room temperature in 30 minutes from a prediction start time every 30 minute prediction timing, in the air-conditioned space in which the indoor units 4 are installed, using the predictive model using multiple operation state amounts relating to air conditioning operation.

The second predicting unit 22 predicts a point of time at which the respective indoor units 4 are switched to the thermo-ON and the thermo-OFF by using the room temperature of the respective indoor units 4 predicted by the first predicting unit 21 and the set temperature that is the target temperature of air conditioning operation. A point of time at which it is switched to the thermo-ON is the thermo-ON time at which the indoor unit 4 turns into the thermo-ON. A point of time at which it is switched to the thermo-OFF is the thermo-OFF time at which the indoor unit 4 turns into the thermo-OFF.

Predictive Model

FIG. 3 is an explanatory diagram illustrating an example of a feature amount of the predictive model. The predictive model stored in the predictive model memory 11 in the server device 6 includes a thermo-OFF predictive model and a thermo-ON predictive model. The thermo-OFF predictive model is a model that predicts an amount of change in the indoor temperature of the indoor space in 30 minutes from the prediction start time during the thermo-OFF, for each of the indoor units 4. The thermo-ON model is a model that predicts an mount of change in the room temperature of the indoor space in 30 minutes from the prediction start time during the thermo-ON, for each of the indoor units 4.

In the present embodiment, the thermo-OFF predictive model predicts an amount of change in the room temperature per second as a target variable by using the Lasso regression algorithm. The feature amount of the thermo-OFF predictive model is, for example, an operation state amount including a set temperature of the indoor space acquired from the respective indoor units 4 and the room temperature, and an outdoor air temperature for each hour from 1 hour before to 20 hours before the prediction start time during the thermo-OFF. The set temperature is a target temperature set to the indoor unit 4. The room temperature is temperature detected by the room temperature sensor 40B. The outdoor air temperature is outdoor air temperature detected by the outdoor temperature sensor 3C of the outdoor unit 3.

The thermo-ON predictive model predicts an amount of change in the room temperature per second as a target variable by using the Lasso regression algorithm. The feature amount of the thermo-ON predictive model is, for example, an operation state amount including a sensor value of the respective indoor units 4 and a sensor value of the outdoor unit 3, and a driving state of a device equipped on the respective indoor units 4 and the outdoor unit 3 in addition to the set temperature of the indoor space acquired from the respective indoor units 4, the room temperature, and an outdoor air temperature for each hour from 1 hour before to 20 hours before the prediction start time during the thermo-ON. The feature amount of the indoor unit 4 includes, for example, a FAN control, an opening degree of an indoor expansion valve, a driving state of a vertical louver and a driving state of a horizontal louver. The FAN control is a driving state of a fan in the indoor unit 4 not illustrated. The opening degree of an indoor expansion valve is acquired by converting the number of pulses in the pulse signal input to a stepping motor that adjusts the opening degree of the expansion valve of the indoor unit 4. The vertical louver operation is an angle of the vertical louver arranged at an air outlet of the indoor unit 4. The horizontal louver operation is an angle of the horizontal louver arranged at the air outlet of the indoor unit 4.

The feature amount of the outdoor unit 3 includes, for example, a FAN rotation speed, a discharge pipe pressure, a liquid pipe pressure, a suction pipe pressure, an opening degree of an outdoor expansion valve, a compressor rotation speed, an inverter current value, a inverter voltage, a high-pressure gas saturation temperature, a low-pressure gas saturation temperature, a high-pressure saturation temperature, and a low-pressure saturation temperature. The FAN rotation speed is a sensor value of a rotation sensor that detects the rotation speed of a fan in the outdoor-unit refrigerant circuit 3A in the outdoor unit 3. The discharge pipe pressure is a sensor value of a pressure sensor that detects a pressure of a discharge pipe in the outdoor-unit refrigerant circuit 3A. The liquid pipe pressure is a sensor value of a pressure sensor that detects a pressure of a liquid pipe in the outdoor-unit refrigerant circuit 3A. The suction pipe pressure is a sensor value of a pressure sensor that detects a pressure of a suction pipe in the outdoor-unit refrigerant circuit 3A. The opening degree of an outdoor expansion valve is information acquired by converting the number of pulses in a pulse signal input to a stepping motor that adjusts the opening degree of an electronic expansion valve in the outdoor-unit refrigerant circuit 3A. The compressor rotation speed is a sensor value of a rotation sensor that detects the rotation speed of the compressor 3A1 in the outdoor-unit refrigerant circuit 3A. The inverter current value is a sensor value of a current sensor that detects a current value of an inverter to drive the compressor 3A1 in the outdoor-unit refrigerant circuit 3A. The inverter voltage value is a sensor value of a voltage sensor that detects a voltage value of an inverter. The high-pressure gas saturation temperature and the high-pressure saturation temperature are values obtained by converting a pressure value detected by a discharge pressure sensor in the outdoor-unit refrigerant circuit 3A into temperature. The low-pressure gas saturation temperature and the low-pressure saturation temperature are values obtained by converting a pressure value detected by a suction pressure sensor in the outdoor-unit refrigerant circuit 3A into temperature.

The control circuit 6C selects a necessary operation state amount (feature amount) from among an enormous number of operation state amounts (feature amounts) using the Lasso regression, generates a predictive model by performing regression analysis using the selected operation state amount, and stores the generated predictive model in the predictive model memory 11. By applying the Lasso regression, a necessary feature amount can be easily selected from among an enormous number of feature amounts to generate a predictive model.

Configuration of Centralized Controller

Figure 4:
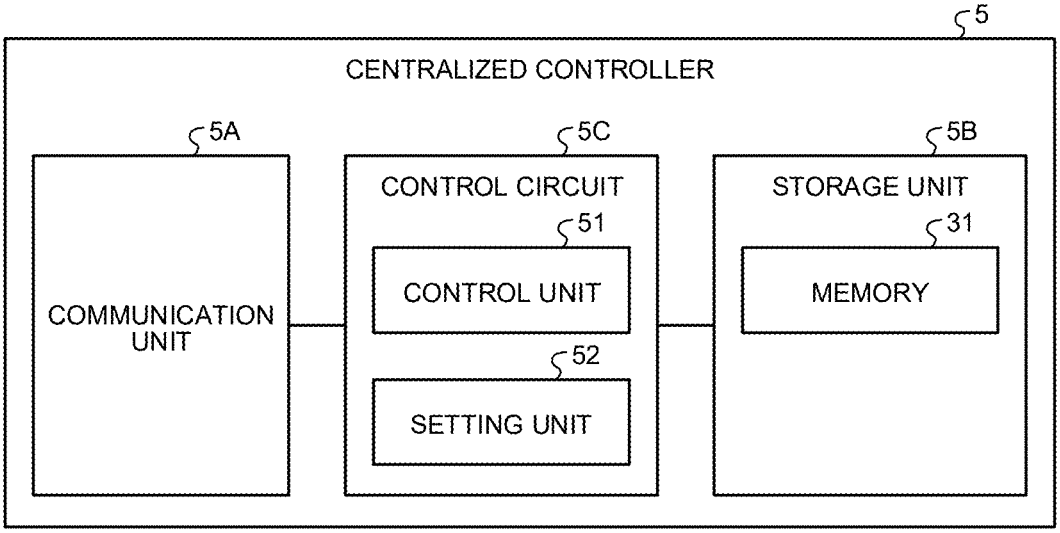
FIG. 4 is a block diagram illustrating an example of a configuration of a centralized controller.

FIG. 4 is a block diagram illustrating an example of a configuration of the centralized controller 5. The centralized controller 5 illustrated in FIG. 4 includes a communication unit 5A, a storage unit 5B, and a control circuit 5C. The communication unit 5A communicates with the indoor unit 4 and the outdoor unit 3 in the air conditioner 2, and communicates with the server device 6 through the communication network 7. The storage unit 5B stores various kinds of information, and includes a memory 31. The storage unit 5B includes the memory 31. The control circuit 5C overall controls the centralized controller 5.

The control circuit 5C includes a control unit 51 and a setting unit 52. The control unit 51 overall controls the control circuit 5C. The control unit 51 controls driving of the compressor 3A1 such that the number of stopping and restarting of driving of the compressor 3A1 in the outdoor-unit refrigerant circuit 3A is reduced according to the thermo-ON or thermo-OFF time of the respective indoor units 4 by using a prediction result of the second predicting unit 22. A method of controlling the compressor 3A1 such that the number of stopping and restarting of driving of the compressor 3A1 is reduced is achieved, for example, by changing the set temperature of the respective indoor units 4 in a predetermined temperature unit such that the thermo-ON periods of two or more units of the indoor units 4 out of the multiple indoor units 4 overlap with each other.

The control unit 51 acquires a prediction result of the second predicting unit 22 in the server device 6 through the communication network 7. The control unit 51 predicts the number of times of stopping and restarting of the compressor 3A1 within a predetermined period of, for example, 30 minutes from the prediction start time by using a prediction result of the thermo-ON time and the thermo-OFF time of each of the indoor unit 4, which is the acquired prediction result of the second predicting unit 22. Furthermore, the control unit 51 identifies the indoor unit 4 that is predicted to be the last ones to be in the thermo-OFF during a predetermined period of, for example 30 minutes from the prediction start time as a reference indoor unit. Furthermore, the setting unit 52 changes, such that a period in which the indoor unit 4 other than the reference indoor unit is in the thermo-ON overlaps with a period in which the reference indoor unit is in the thermo-ON, the set temperature of the other indoor unit 4 subject to change in a predetermined temperature unit. The predetermined temperature unit is, for example, a unit of 1° C.

When the set temperature of the indoor unit 4 is changed by the setting unit 52, the control unit 51 acquires a prediction result predicting the thermo-ON time and the thermo-OFF time of the respective indoor units 4 from the second predicting unit 22 based on the set temperature after the change. The control unit 51 controls the indoor unit 4 using the prediction result of the second predicting unit 22.

Configuration of Memory

Figure 5:
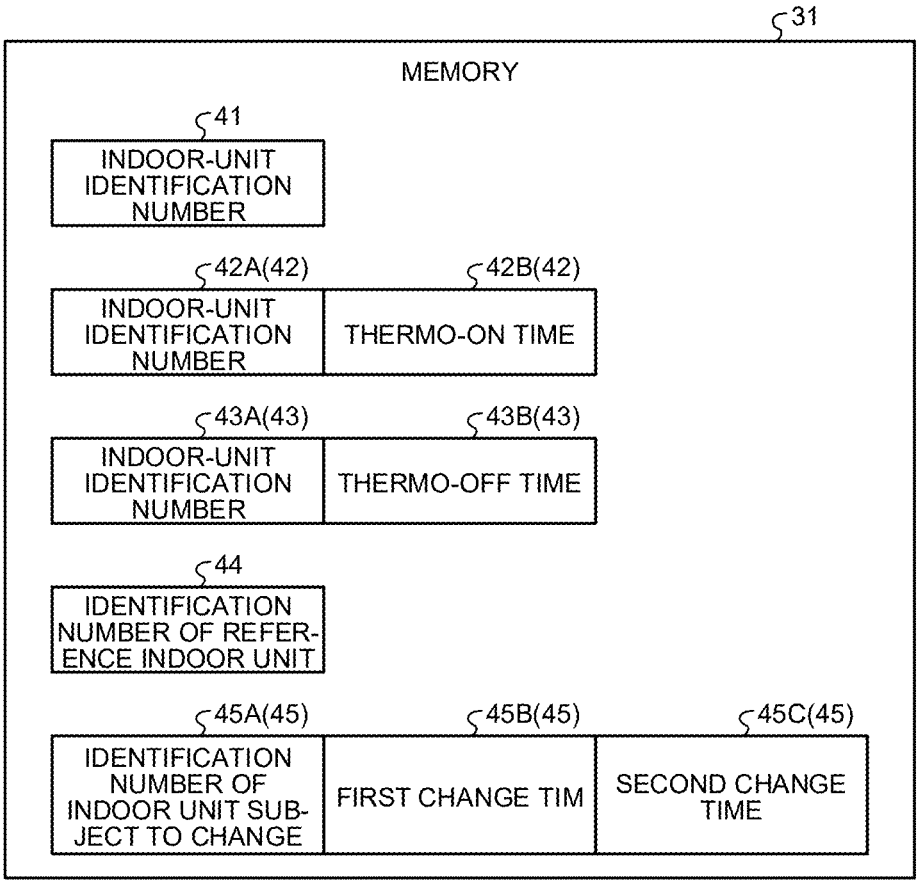
FIG. 5 is an explanatory diagram illustrating an example of a memory configuration of a memory.

FIG. 5 is an explanatory diagram illustrating an example of a memory configuration of the memory 31. The memory 31 illustrated in FIG. 5 includes an indoor unit memory 41, a thermo-ON time memory 42, a thermo-OFF time memory 43, a reference indoor-unit memory 44, and a change target memory 45.

The indoor unit memory 41 stores identification numbers to identify the respective indoor units 4 of the air conditioner 2. The thermo-ON time memory 42 stores a prediction result of the thermo-ON time of the respective indoor units 4 predicted by the second predicting unit 22. The thermo-ON memory 42 stores a thermo-ON time 42B for each of an indoor identification number 42A to identify the indoor unit 4.

The thermo-OFF time memory 43 stores a prediction result of the thermo-OFF time of the respective indoor unit 4 predicted by the second predicting unit 22. The thermo-OFF time memory 43 stores a thermo-OFF time 43B for each of an indoor identification number 43A to identify the indoor unit 4. The reference indoor-unit memory 44 stores an identification number to identify the identified reference indoor unit among the multiple indoor units 4.

The change target memory 45 stores a first change time and a second change time of the indoor unit 4 subject to changing the set temperature. The change target memory 45 stores an indoor identification number 45A subject to change to identify the indoor unit 4 subject to change, a first change time 45B that is a timing of changing the set temperature, and a second change time 45C that is a timing of returning the set temperature to the set temperature before change in an associated manner.

Processing of First Predicting Unit and Second Predicting Unit

Figure 6:
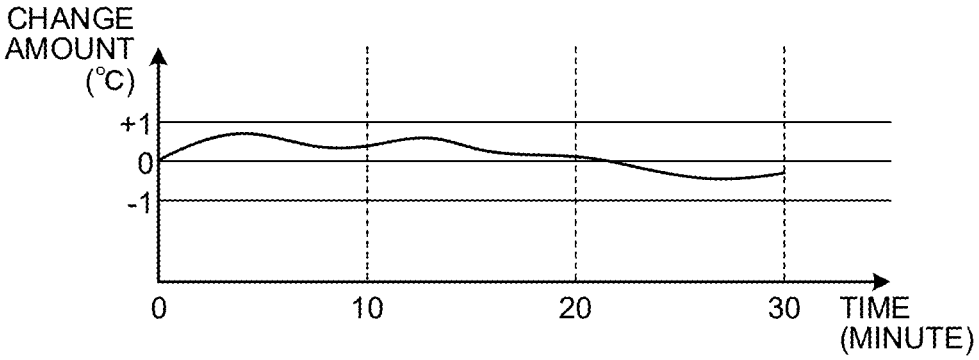
FIG. 6 is an explanatory diagram illustrating an example of a prediction result of a room-temperature change amount.

FIG. 6 is an explanatory diagram illustrating an example of a prediction result of a room-temperature change amount. FIG. 6 illustrates an example of a prediction result of a room temperature change amount during the cooling operation. The first predicting unit 21 predicts an amount of change in the indoor temperature of the indoor unit 4 in 30 minutes from the prediction start time by using the predictive model.

Figure 7:
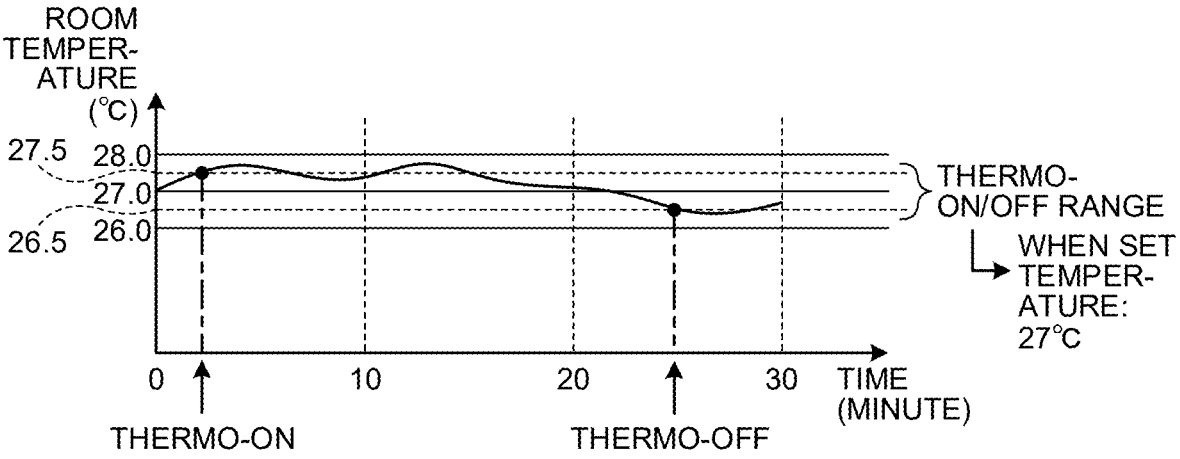
FIG. 7 is an explanatory diagram illustrating an example of a prediction result of a thermo-ON/OFF time.

FIG. 7 is an explanatory diagram illustrating an example of a prediction result of the thermo-ON/OFF time. The first predicting unit 21 predicts the room temperature in 30 minutes from the prediction start time by adding the room temperature detected at the prediction start time to the change amount in the room temperature in 30 minutes from the prediction start time.

Furthermore, the second predicting unit 22 predicts the thermo-ON time and the thermo-OFF time of the respective indoor units 4 by using the predicted room temperature of 30 minutes and the set temperature, which is the target value of the air conditioning operation. The thermo-ON temperature during the cooling operation is +5° C. of the set temperature, and the thermo-OFF temperature is −5° C. of the set temperature. For example, when the set temperature is 27° C., the thermo-ON temperature is 27.5° C., and the thermo-OFF temperature is 26.5° C. Moreover, The thermo-ON temperature during the heating operation is −5° C. of the set temperature, and the thermo-OFF temperature is +5° C. of the set temperature. For example, when the set temperature is 20° C., the thermo-ON temperature is 19.5° C., and the thermo-OFF temperature is 20.5° C.

The second predicting unit 22 predicts the thermo-ON time as a point of time when the room temperature exceeds the thermo-ON temperature, 27.5° C., using the predicted room temperature in 30 minutes from the prediction start time and the set time, which is the target value of the air conditioning operation. Furthermore, the second predicting unit 22 predicts the thermo-OFF time as a point of time when the room temperature falls to be lower than 26.5° C., which is the thermo-OFF temperature, from the predicted thermo-ON time. That is, the second predicting unit 22 predicts the thermo-ON time and the thermo-OFF time of the respective indoor units 4 in 30 minutes from the prediction start time.

Figure 8:
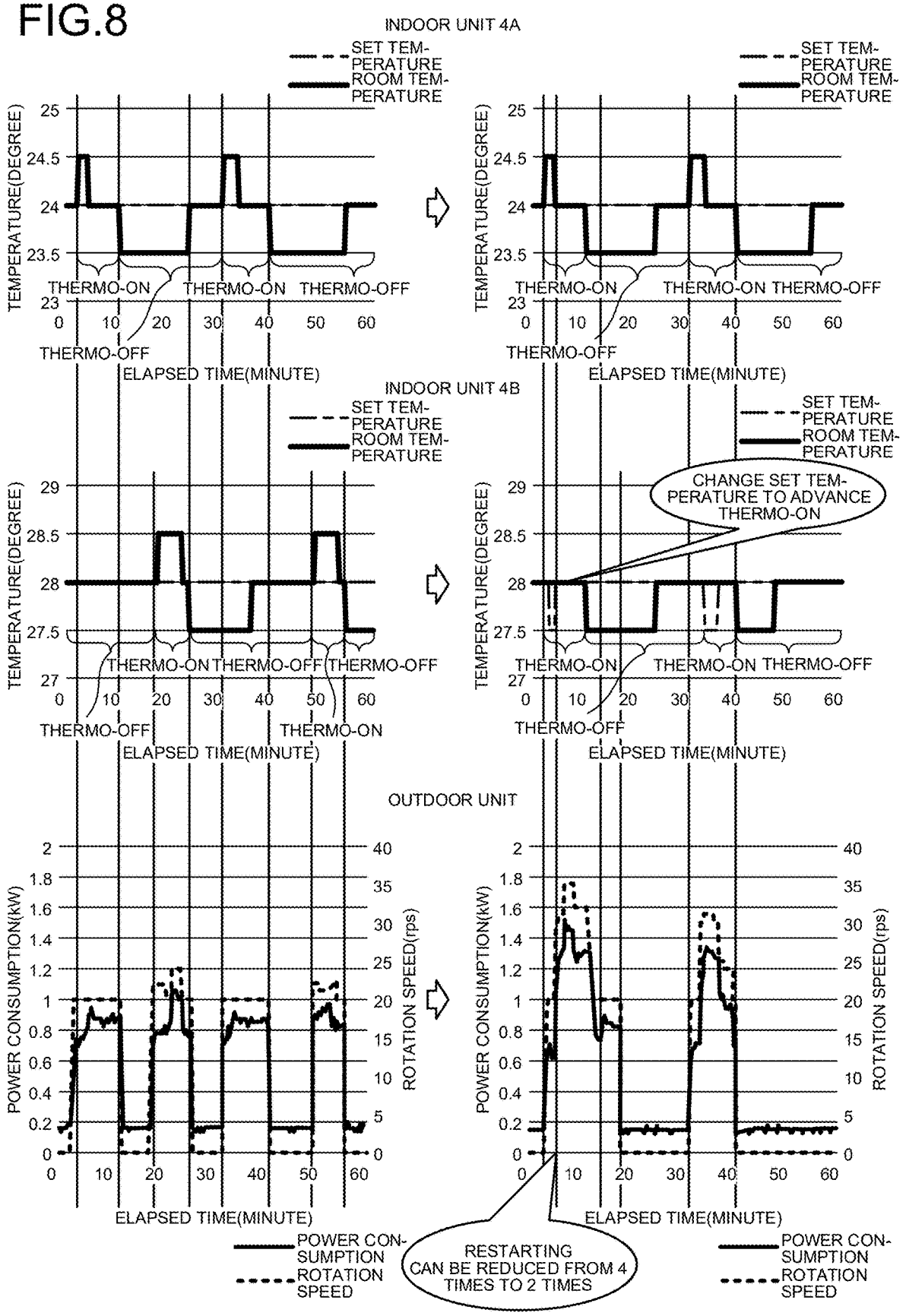
FIG. 8 is an explanatory diagram illustrating an example of variations in power consumption of a compressor by timing adjustment of thermo-ON/OFF for each indoor unit according to the first embodiment.

FIG. 8 is an explanatory diagram illustrating an example of variations in power consumption of the compressor 3A1 by timing adjustment of the thermo-ON/OFF of the respective indoor units 4 according to the first embodiment. For convenience of explanation, the operation during the cooling operation will be explained, assuming that there is one unit of the outdoor unit 3 and two units of the indoor units 4 in operation. FIG. 8 illustrates prediction results of room temperature of rooms in which the respective indoor units 4 (an indoor unit 4A and an indoor unit 4B in FIG. 8) are installed, a prediction result of timing to be switched to the thermo-ON or the thermo-OFF, a prediction result of timing of stopping and restarting of the compressor 3A1, and a detection result of variations of power consumption according to the thermo-ON/OFF in the respective indoor units 4A, 4B, and the left side of the drawing indicates a prediction result before timing adjustment of the thermo-ON/OFF of the respective indoor units 4A, 4B, and the right side of the drawing indicates a prediction result after the timing adjustment of the thermo-ON/OFF. For the detection result of variations of power consumption, stopping/driving of the compressor 3A1 when the prediction result of the room temperature of the indoor unit 4A and the indoor unit 4B to be predicted and the prediction result of switching timing to the thermo-ON or the thermo-OFF are implemented on actual hardware and variations of the power consumption at that time are respectively detected.

First, an example of prediction of variations of power consumption of the compressor 3A1 before timing adjustment will be explained. The indoor unit 4A is configured such that the set temperature is 24° C., the thermo-ON temperature is 24.5° C., and the thermo-OFF temperature is 23.5° C. In the prediction result of 60 minutes of the indoor unit 4A, first, starting from the thermo-ON state, the room temperature becomes lower than the thermo-OFF temperature when elapsed time is 10 minutes, to be switched to the thermo-OFF. Subsequently, the room temperature rises to the thermo-ON temperature when the elapsed time is between 30 minutes and 40 minutes, and the indoor unit 4A is switched to the thermo-ON. Subsequently, the room temperature again becomes lower than the thermo-OFF temperature when the elapsed time is 40 minutes, and the indoor unit 4A is switched to the thermo-OFF, and thereafter maintains the thermo-OFF until 60 minutes elapse. That is, in the example before the timing adjustment illustrated in FIG. 8, there are two thermo-ON periods and two thermo-OFF periods within 60 minutes.

On the other hand, the indoor unit 4B is configured such that the set temperature is 28° C., the thermo-ON temperature is 28.5° C., and the thermo-OFF temperature is 27.5° C. In the prediction result of 60 minutes of the indoor unit 4B, starting from the thermo-ON state, when the room temperature reaches the thermo-ON temperature when elapsed time is 20 minutes, it is switched to the thermo-ON. Subsequently, the room temperature becomes lower than the thermo-OFF temperature when the elapsed time is 25 minutes, and the indoor unit 4B is switched from the thermo-ON to the thermo-OFF. Subsequently, when the room temperature reaches the thermo-ON temperature when the elapsed time is 50 minutes, the indoor unit 4B is switched to the thermo-ON. Subsequently, the room temperature becomes lower than the thermo-OFF temperature when the elapsed time is 55 minutes, and the indoor unit 4B is switched to the thermo-OFF. That is, in the example before the timing adjustment illustrated in FIG. 8, there are two thermo-ON periods and two thermo-OFF periods in 60 minutes.

In the outdoor unit 3, when either one of the indoor units 4A, 4B is in the thermo-ON period, the compressor 3A1 is turned ON, and when the indoor units 4A, 4B are both in the thermo-OFF period, the compressor 3A1 is turned OFF. That is, in the prediction example before timing adjustment illustrated in FIG. 8, there are four periods in which the indoor units 4A, 4B are both in the thermo-OFF, which are the elapsed time is between 10 minutes to 20 minutes, 25 minutes to 30 minutes, 40 minutes to 50 minutes, and 55 minutes to 60 minutes, and the number of stops of the compressor 3A1 within 60 minutes is predicted as four times, and the number of restart of the compressor 3A1 is predicted as three times. As described previously, restarting the compressor 3A1 uses a significant amount of power, and it is predicted that the air conditioning system 1 before timing adjustment has three times of restart that consumes a significant amount of power.

In the present invention, by adjusting the thermo-ON/OFF timing such that the thermo-ON periods of the multiple indoor units 4 overlap with each other, the number of times of stopping and restarting of the compressor 3A1 is reduced, and the power consumption associated with restarting of the compressor 3A1 is thereby reduced. Specifically, referring to the prediction result before timing adjustment explained so far, the thermo-ON period of the indoor unit 4B is adjusted by adjusting the set temperature of the indoor unit 4B such that the thermo-ON period of the indoor unit 4A overlaps with the thermo-ON period of the indoor unit 4B.

Specifically, as indicated on the right side of FIG. 8, in the indoor unit 4B, by lowering the set temperature at a point when the elapsed time is 0 minutes, the timing of switching to the thermo-ON of the indoor unit 4B is advanced compared to the prediction result indicated on the left side of FIG. 8. As a result, the thermo-ON period of the indoor unit 4B overlaps with the thermo-ON period of the indoor unit 4A during the period in which the elapsed time is 0 minutes to 10 minutes and, therefore, the number of times of stopping and restarting of driving of the compressor 3A1 is one time during the period from 0 minutes to 30 minutes. Moreover, by lowering the set temperature at a point when the elapsed time is 35 minutes, the timing of switching to the thermo-ON of the indoor unit 4B is advanced compared to the prediction result indicated on the left side of FIG. 8. As a result, the thermo-ON period of the indoor unit 4B overlaps with the thermo-ON period of the indoor unit 4A during the period in which the elapsed time is 35 minutes to 40 minutes and, therefore, the number of times of stopping and restarting of driving of the compressor 3A1 is one time during the period from 30 minutes to 60 minutes. That is, in the example after timing adjustment illustrated in FIG. 8, because the number of times of restarting of the compressor 3A1 is two times in 60 minutes, power consumption associated with restarting of the compressor 3A1 can be reduced. In the air conditioning system 1 after the timing adjustment, power consumption can be significantly reduced compared to power consumption before the timing adjustment.

Operation of Air Conditioning System

Next, processing of adjusting timing of the thermo-ON/OFF such that the thermo-ON periods of the multiple indoor units 4 overlap with each other will be explained in detail.

Figure 9:
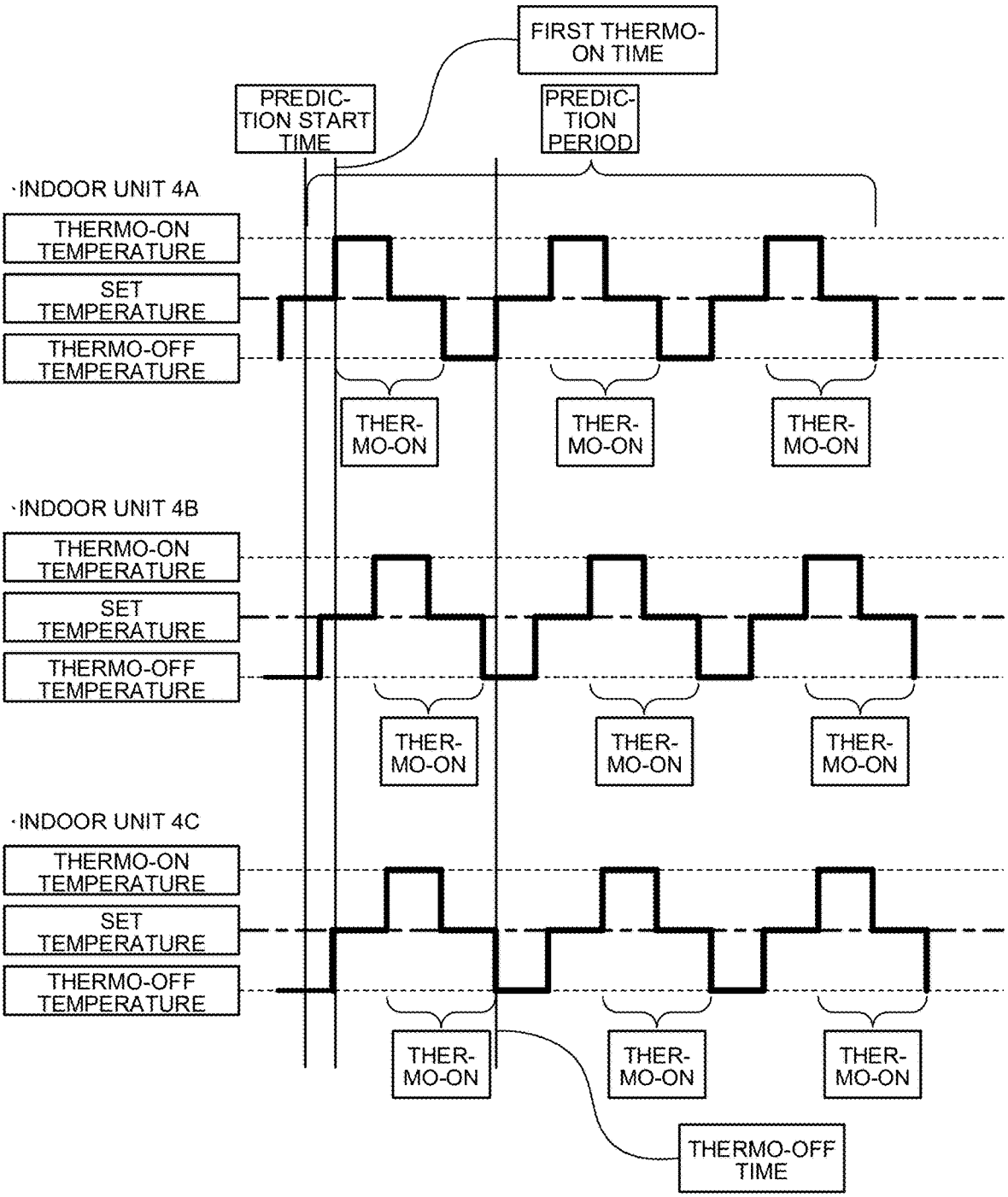
FIG. 9 is an explanatory diagram illustrating an example of processing operation when an indoor unit to be turned into the thermo-ON first from a prediction start time is identified.

FIG. 9 is an explanatory diagram illustrating an example of processing operation when the indoor unit 4 to be the first one to be in the thermo-ON from the prediction start time is identified. For convenience of explanation, it is explained assuming that the number of the indoor units 4 in cooling operation is three (denoted as the indoor unit 4A, the indoor unit 4B, and an indoor unit 4C in the drawing). The second predicting unit 22 predicts, after predicting the room temperature of the respective indoor units 4 (4A, 4B, 4C) in a prediction period of 30 minutes from the prediction start time in the first predicting unit 21, the thermo-ON time and the thermo-OFF time of the respective indoor units 4 using the predicted room temperature and the set temperature. The control unit 51 acquires a prediction result of the second predicting unit 22. The control unit 51 determines whether there is the indoor unit that is in the thermo-ON at the prediction start time based on the prediction result of the second predicting unit 22. When there is no indoor unit 4 in the thermo-ON at the prediction start time, the control unit 51 identifies the indoor unit 4 that is predicted to be the first one to be in the thermo-ON after the prediction start time. In explanation herein, the control unit 51 identifies the indoor unit 4A in FIG. 9 as the first indoor unit 4 to be in the thermo-ON.

Figure 10:
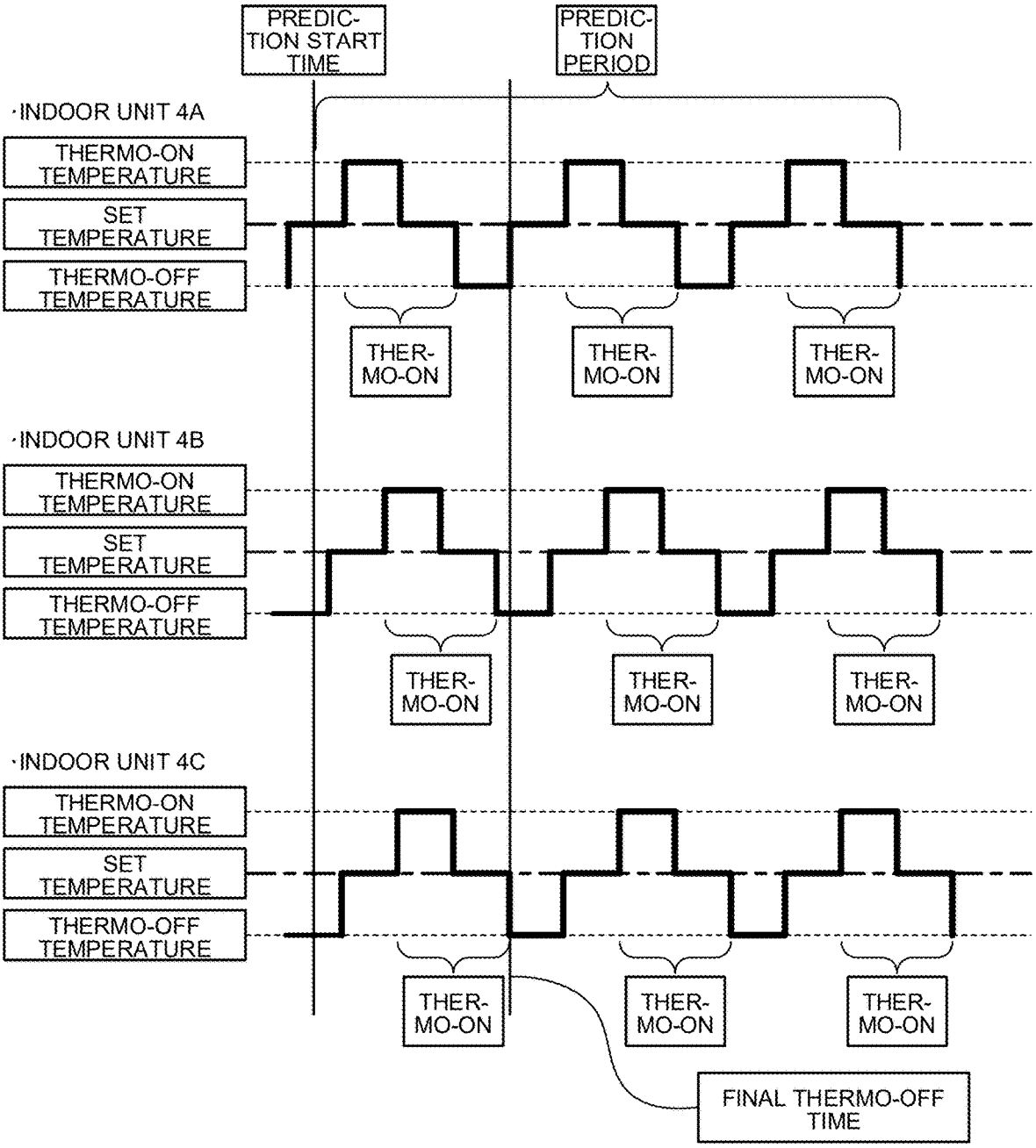
FIG. 10 is an explanatory diagram illustrating an example of processing operation when an indoor unit to be turned into the thermo-OFF first from the prediction start time (reference indoor unit).

FIG. 10 is an explanatory diagram illustrating an example of processing operation when the indoor unit 4 (reference indoor unit) to be the last one to be in the thermo-OFF from the prediction start time is identified. The control unit 51 determines, after identifying the first indoor unit 4 to be in the thermo-ON, whether there is another indoor unit 4 to be switched to the thermo-ON during the period before the identified indoor unit 4A is switched to the thermo-OFF. Where there is no other indoor units 4 to be switched to the thermo-ON, the control unit 51 stores the thermo-OFF time of the indoor unit 4A in the thermo-OFF time memory 43. In this example, because there are two other indoor units 4 (the indoor unit 4B and the indoor unit 4C) to be switched to the thermo-ON in FIG. 10, the control unit 51 determines the indoor unit 4C that is switched to the thermo-OFF later than the indoor unit 4B and last among the three indoor units 4 as the reference indoor unit.

The control unit 51 identifies the indoor unit 4C that is the last one to be switched to the thermo-OFF as the reference indoor unit, and stores the identification number of the identified reference indoor unit in the reference indoor-unit memory 44.

Figure 11:
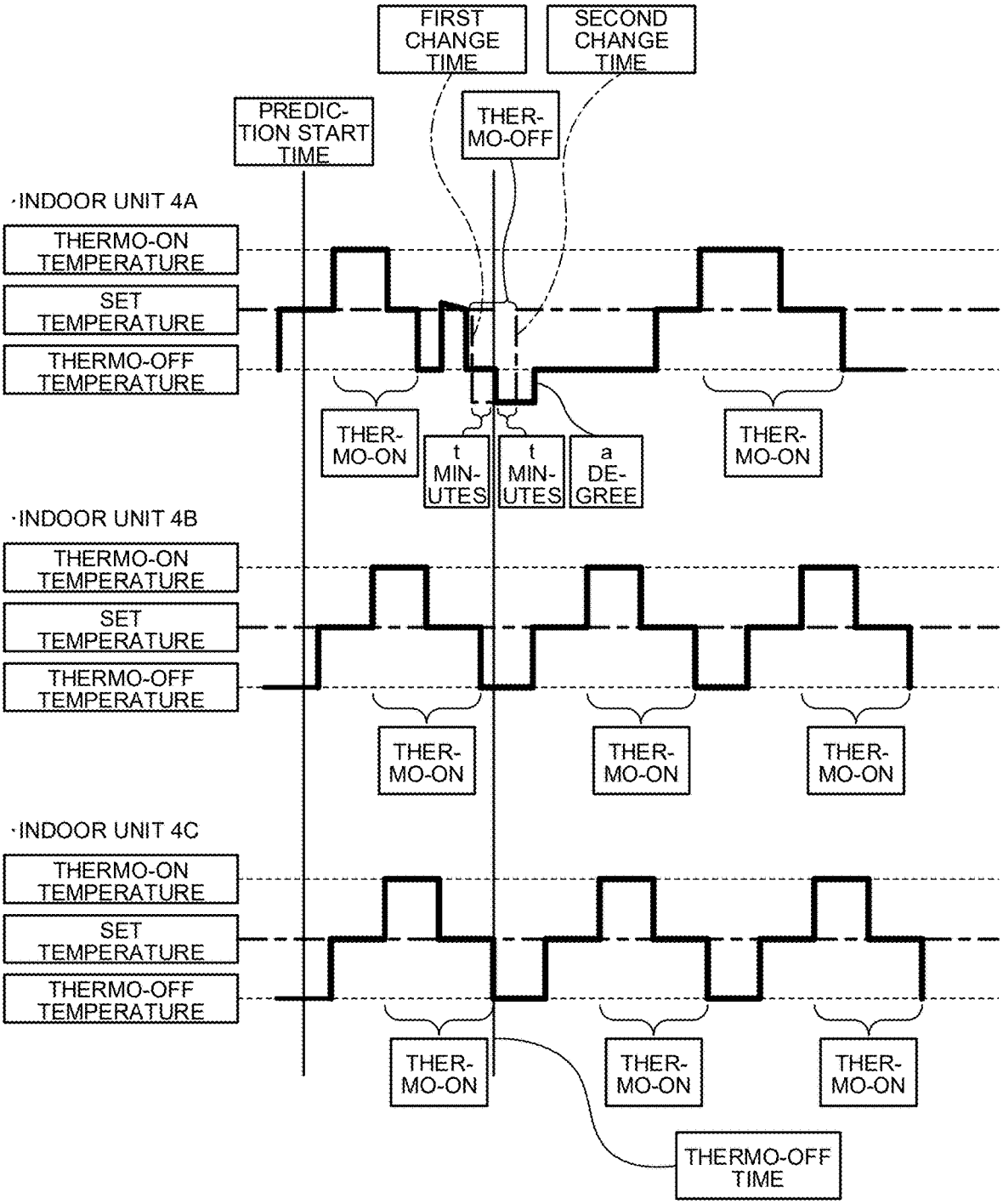
FIG. 11 is an explanatory diagram illustrating an example of processing operation when predicting a first change time and a second change time relating to changes of a set temperature of other indoor units.

FIG. 11 is an explanatory diagram illustrating an example of processing operation when the first change time and the second change time relating to change of the set temperature of the other indoor units 4 are predicted. After identifying the indoor unit 4C as the reference indoor unit, the control unit 51 identifies the indoor unit 4 that is the first one to be switched to the thermo-ON from the thermo-OFF time of the reference indoor unit, as the indoor unit 4 subject to changing the set temperature. The control unit 51 stores the identification number of the indoor unit 4 subject to setting changing in the change target memory 45. In this example, the control unit 51 identifies the indoor unit 4A that is the first indoor unit 4 to be in the thermo-ON from the thermo-OFF time of the reference indoor unit as the indoor unit 4 subject to changing the set temperature as illustrated in FIG. 10.

Furthermore, the control unit 51 determines t minutes prior to a reference time, which is the thermo-OFF time of the reference indoor unit as the first change time, and determines t minutes after the reference time as the second change time. The reason why it is set to t minutes prior to the reference time is to prevent a situation that all of the indoor units 4 are in the thermo-OFF by switching the indoor unit 4A to the thermo-ON before the thermo-OFF time of the reference unit. Moreover, the reason why it is set to t minutes after the reference time is to ensure user comfort by avoiding a state in which the set temperature is low (a state in which an excessive cooling performance is exhibited) from being maintained for a long time. Although a case of setting it to t minutes before and after the reference time has been described as an example for convenience of explanation, it may be a different time, not identically setting to t minutes for before and after the reference time.

The control unit 51 stores the identification number of the indoor unit 4 subject to changing the set temperature, the first change time, and the second change time in the change target memory 45. The setting unit 52 sets the set temperature of the indoor unit 4A subject to changing the set temperature to a temperature lower than a current set temperature by 1° C. when it becomes the first change time, and thereafter returns the set temperature of the indoor unit 4A subject to setting change back to the set temperature before change when it becomes the second change time. As a result, by returning it to the set temperature before change because an excessive air conditioning performance (not wished by a user) is exhibited if the set temperature is maintained low, user comfort can be ensured.

By thus changing the set temperature of the indoor unit 4A subject to setting changing to a temperature lower than a current set temperature by 1° C., the temperature at which it is switched to the thermo-ON also becomes lower. Therefore, the room temperature becomes higher than the thermo-ON temperature at the first change time, and the indoor unit 4A is switched to thermo-ON. That is, because The timing of switching to the thermo-ON becomes earlier than the second thermo-ON timing of the indoor unit 4A in the prediction result illustrated in FIG. 9, the indoor unit 4A subject to setting change is switched to the thermo-ON while the indoor unit 4C determined as the reference indoor unit is in the thermo-ON. Therefore, a period in which all of the indoor units 4 are in the thermo-OFF at first illustrated in FIG. 9 is eliminated. In the outdoor unit 3, the number of restarting of the compressor 3A1 is reduced because the thermo-ON period of the respective indoor units 4 continues.

Figure 12:
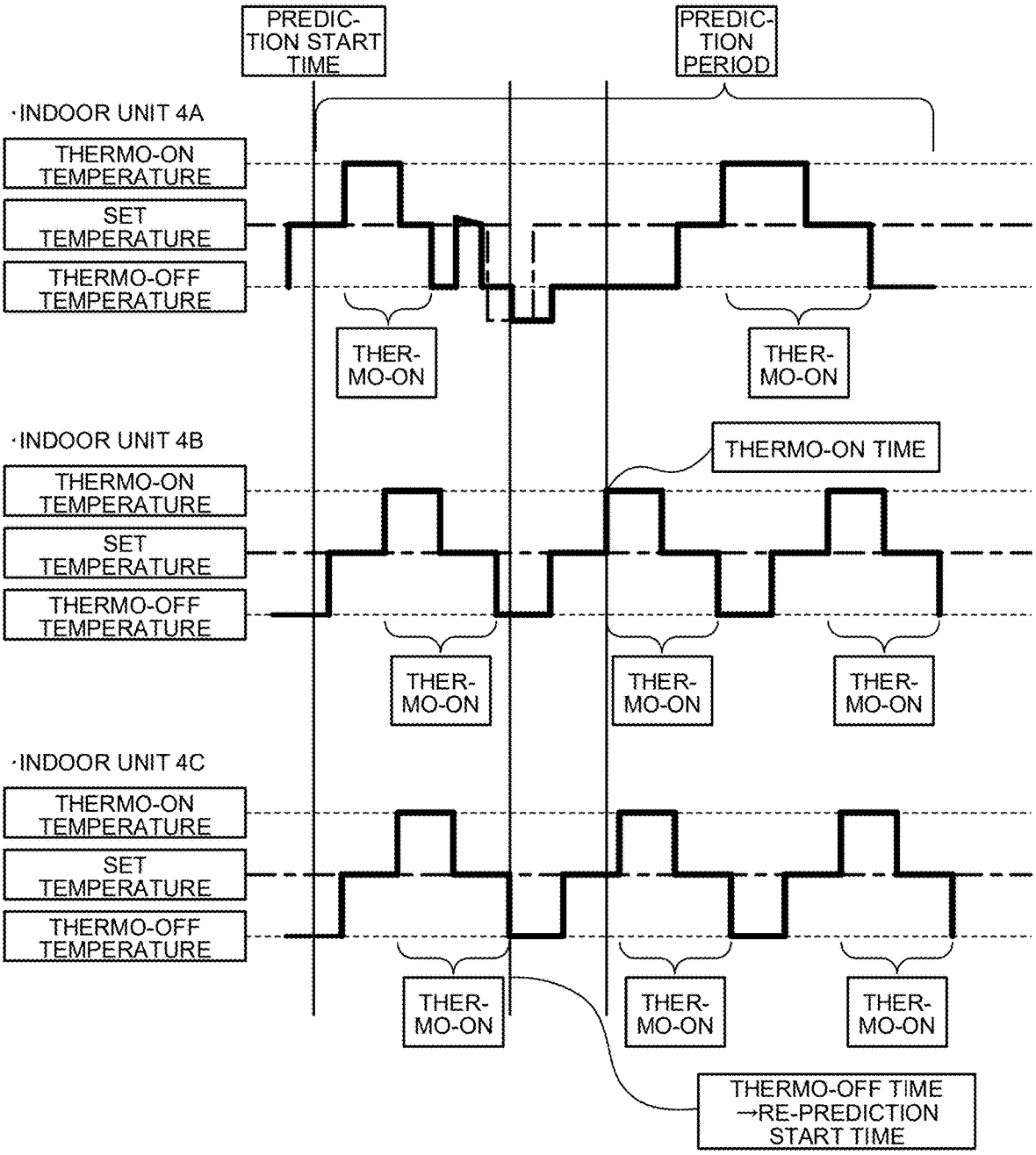
FIG. 12 is an explanatory diagram illustrating an example of processing operation when a next prediction start time is set.

FIG. 12 is an explanatory diagram illustrating an example of processing operation when a next prediction start time is set. The setting unit 52 sets the thermo-OFF time of the indoor unit 4C determined to be the reference indoor unit as the next prediction start time. The second predicting unit 22 predicts the thermo-ON time and the thermo-OFF time of the respective indoor units 4 after predicting the room temperature of the respective indoor units 4 within the prediction period of 30 minutes from the prediction start time. The control unit 51 determines whether there is any indoor unit 4 that is in the thermo-ON at the prediction start time based on the prediction result of the second predicting unit 22. When there is no indoor unit 4 in the thermo-ON at the prediction start time, the control unit identifies the indoor unit 4 that is predicted to be the first one to be in the thermo-ON after the prediction start time. In this case, the control unit 51 identifies the indoor unit 4B as the first indoor unit 4 to be in the thermo-ON in FIG. 12.

Furthermore, after identifying the indoor unit 4 of the first thermo-ON time, the control unit 51 determines whether there is another indoor unit 4 that is switched to the thermo-ON during the period until the identified indoor unit 4B is switched to the thermo-OFF. The control unit 51 stores the thermo-OFF time of the indoor unit 4B in the thermo-OFF time memory 43 when there is no other indoor units 4 that is switched to the thermo-ON. In this explanation, because there are other indoor units 4 that are switched to the thermo-ON in FIG. 12, the control unit 51 determines the indoor unit 4A that is switched to the thermo-OFF later than the indoor unit 4C out of the indoor unit 4A and the indoor unit 4C that are switched to the thermo-ON as the reference indoor unit. The control unit 51 identifies the indoor unit 4 that is the first one to be switched to the thermo-ON from the thermo-OFF time of the reference indoor unit as the indoor unit 4 subject to set changing. The setting unit 52 adjusts the thermo-ON period of the indoor unit 4 subject to set changing by changing the set temperature of the indoor unit 4 subject to set changing so as to overlap with the thermo-ON period of the reference indoor unit. FIG. 12 only expresses the operation until identification of the reference indoor unit and the indoor unit 4 subject to set changing, and the processing operation in FIG. 9 to FIG. 11 will be repeated.

Figure 13:
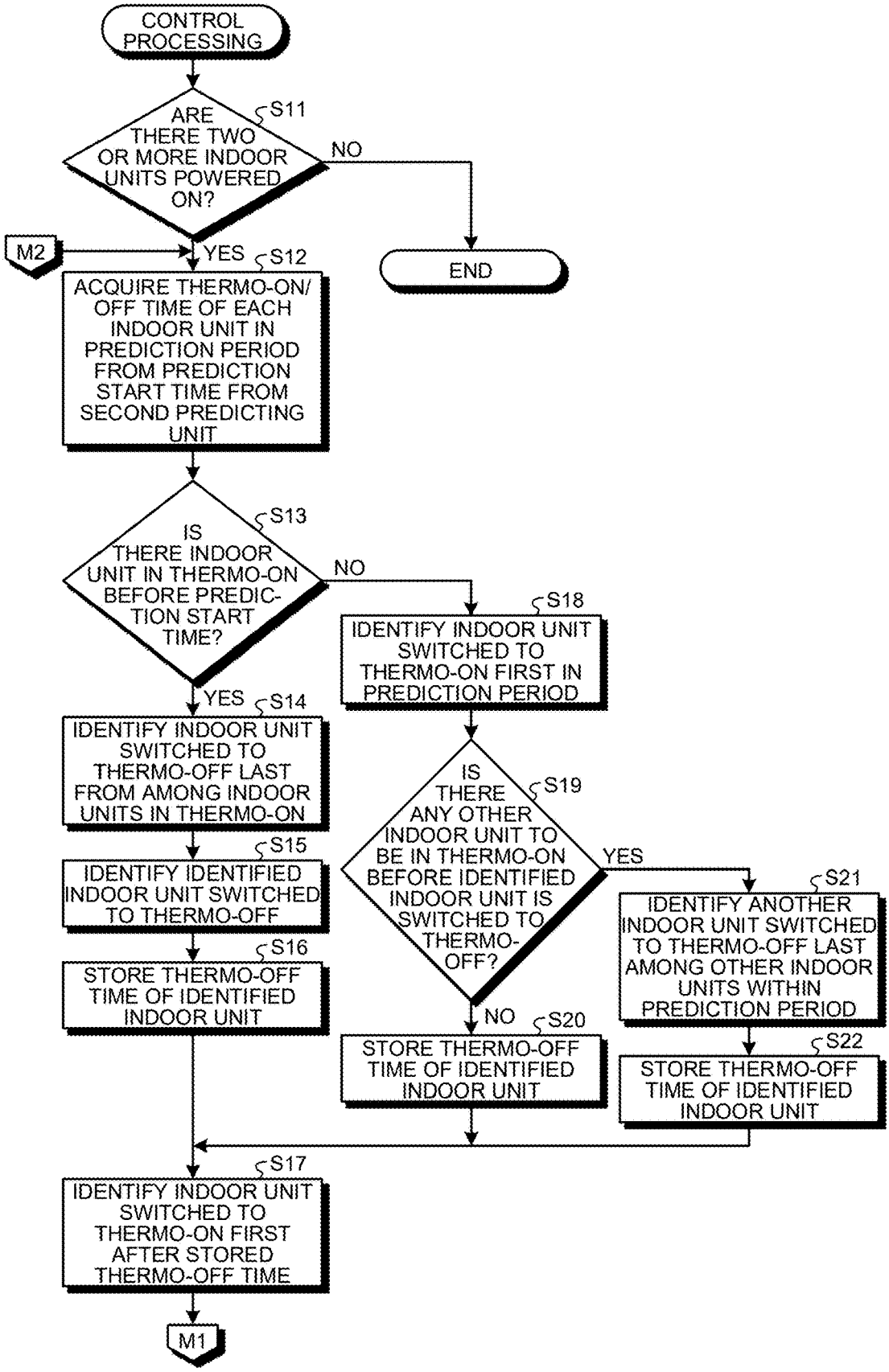
FIG. 13 is a flowchart illustrating an example of processing operation of the centralized controller relating to control processing.

FIG. 13 is a flowchart illustrating an example of processing operation of the centralized controller 5 relating to control processing. The control processing is started at the prediction timing of every 30 minutes. In FIG. 13, the control unit 51 in the control circuit 5C in the centralized controller 5 determines whether there are two or more of the indoor units 4 that are powered ON (step S11). When there are two or more of the indoor units 4 powered ON (step S11: YES), the control unit 51 acquires a prediction result of the second predicting unit 22 in the server device 6 (step S12). The prediction result of the second predicting unit 22 is the thermo-ON/thermo-OFF times of the respective indoor units 4 during a prediction period from the prediction start time, for example, 30 minutes.

The control unit 51 refers to the second prediction result, and determines whether there is the indoor unit 4 that is in the thermo-ON before the prediction start time (step S13). When there is the indoor unit 4 in thermo-ON before the prediction start time (step S13: YES), the control unit 51 identifies the indoor unit 4 that is the last one to be in the thermo-OFF among the indoor units 4 that are in the thermo-ON (step S14).

The control unit 51 identifies the indoor unit identification number of the identified indoor unit 4 that is the last one to be switched to the thermo-OFF (step S15). The identified indoor unit 4 that is the last one to be switched to the thermo-OFF is to be the reference indoor unit. When the indoor unit identification number of the indoor unit 4 is identified, the control unit 51 stores the thermo-OFF time of the identified indoor unit 4 in the thermo-OFF time memory 43 (step S16). The control unit 51 identifies the indoor unit 4 that is the first one to be switched to the thermo-ON after the stored thermo-OFF time (step S17), and shifts to processing of M1 in FIG. 14.

When there is no indoor unit 4 that is in thermo-ON before the prediction start time (step S13: NO), the control unit identifies the indoor unit 4 that is the first one to be switched to the thermo-ON during the prediction period (step S18). The indoor unit 4 that is the first one to be switched to the thermo-ON is the indoor unit 4A in the example illustrated in FIG. 9. The control unit 51 determines whether there is any other indoor unit 4 to be switched to the thermo-ON during the period until the identified indoor unit 4 that is the first one to be switched to the thermo-ON is switched to the thermo-OFF (step S19). The other indoor unit 4 to be switched to the thermo-ON is the indoor unit 4B and the indoor unit 4C in the example illustrated in FIG. 9.

Where there is no other indoor unit 4 to be switched to the thermo-ON during the period until the identified indoor unit 4 that is the first one to be switched to the thermo-ON is switched to the thermo-OFF (step S19: NO), the control unit 51 stores the thermo-OFF time of the identified indoor unit 4 that is the first one to be switched to the thermo-ON in the thermo-OFF time memory 43 (step S20). The control unit 51 returns to the processing at step S17 to identify the indoor unit 4 that is the first one to be switched to the thermo-ON after the stored thermo-OFF time.

When there is the other indoor unit 4 to be switched to the thermo-ON during the period until the identified indoor unit 4 that is the first one to be switched to the thermo-ON is switched to the thermo-OFF (step S19: YES), the control unit 51 identifies the other indoor unit 4 that is the last one to be switched to the thermo-OFF in the prediction period among the other indoor units 4 (step S21). The indoor unit 4 that is the last one to be switched to the thermo-OFF is the indoor unit 4C in the example illustrated in FIG. 9. The indoor unit 4 that is the last one to be switched to the thermo-OFF is to be the reference indoor unit.

The control unit 51 stores the thermo-OFF time of the other of the identified other indoor unit 4 that is the last one to be switched to the thermo-OFF in the thermo-OFF time memory 43 (step S22). In the thermo-OFF time memory 43, the indoor unit identification number and the thermo-OFF time of the indoor unit 4C to be the indoor unit 4 that is the last one to be switched to the thermo-OFF are stored. The control unit 51 returns to the processing at step S17 to identify the indoor unit 4 that is the first one to be switched to the thermo-ON after the stored thermo-OFF time. The indoor unit 4 that is the first one to be switched to the thermo-ON is the indoor unit 4A in the example illustrated in FIG. 10. Moreover, when the number of the indoor units 4 powered ON is not two or more (step S11: NO), the control unit 51 ends the processing operation illustrated in FIG. 13.

Figure 14:
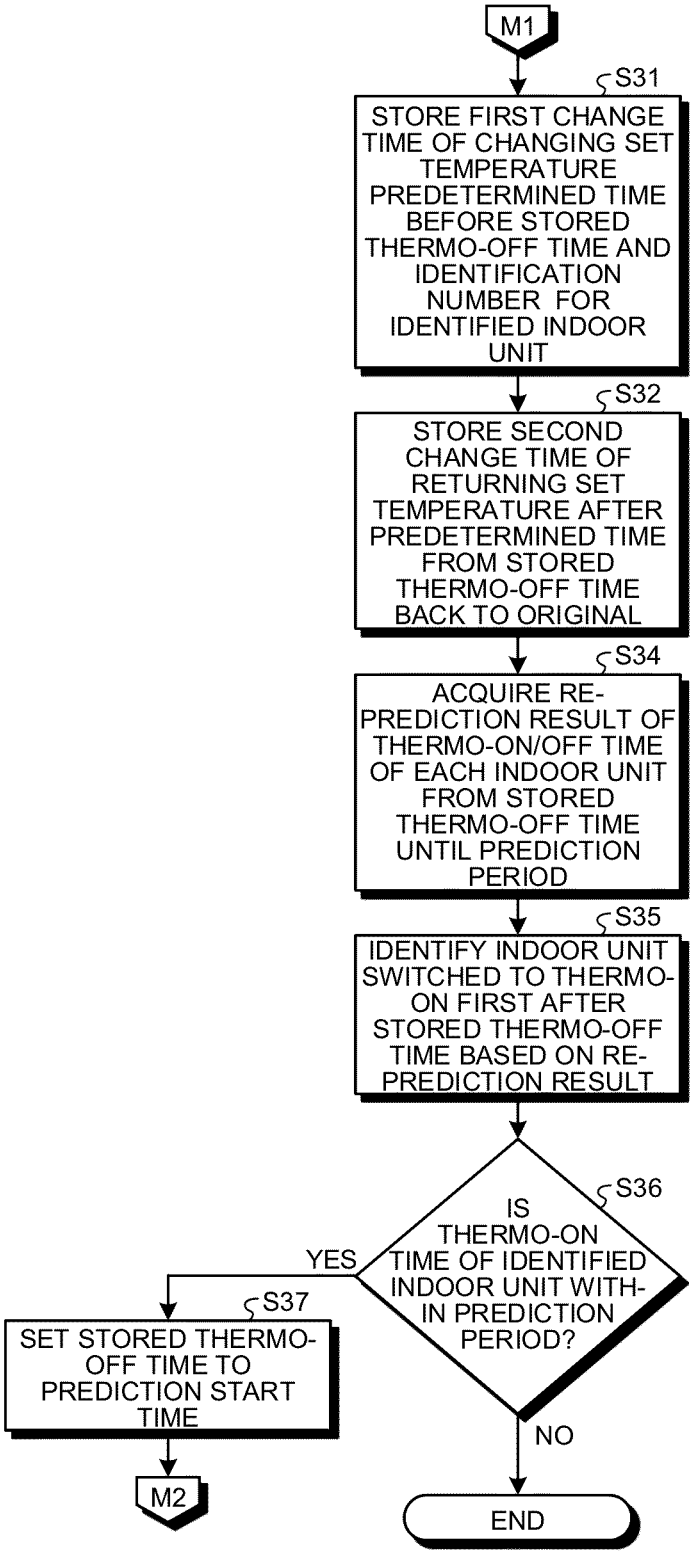
FIG. 14 is a flowchart illustrating an example of processing operation of the centralized controller relating to control processing.

FIG. 14 is a flowchart illustrating an example of processing operation of the centralized controller 5 relating to control processing. FIG. 14 illustrates processing following M1 in FIG. 13. At M1 in FIG. 14, the control unit 51 stores the identification number of the identified indoor unit 4 that is the first one to be switched to the thermo-OFF after the thermo-OFF time stored at step S17, and the first change time which is the timing of changing the set temperature predetermined time of t minutes before the stored thermo-OFF time in the change target memory 45 (step S31). The stored thermo-OFF time is the thermo-OFF time of the indoor unit 4C in the example in FIG. 11. Furthermore, the control unit 51 stores the second change time, which is the timing of changing the set temperature predetermined time of t minutes later from the stored thermo-OFF time, in the change target memory 45 (step S32). That is, in the change target memory 45, the indoor unit identification number of the indoor unit 4 subject to changing of the set temperature, the first change time, and the second change time are stored.

The control unit 51 acquires a re-prediction result of the second predicting unit 22 that re-predicts the thermo-ON/OFF time of the respective indoor units 4 from the stored thermo-OFF time to the prediction period through the communication network 7 (step S34). The prediction period is not the re-prediction start time, but the prediction period starting from the first prediction start time. Specifically, the control unit 51 notifies a new prediction start time to the second predicting unit 22. Furthermore, the second predicting unit 22 that has received the new prediction start time performs prediction for 30 minutes from the new prediction start time, to notify the control unit 51.

The control unit identifies the indoor unit 4 that is the first one to be switched to the thermo-ON after the stored thermo-OFF time based on the re-prediction result (step S35). The stored thermo-OFF time is the thermo-OFF time of the indoor unit 4C in the example in FIG. 12. Furthermore, the indoor unit 4 that is the first one to be switched to the thermo-ON after the thermo-OFF time is the indoor unit 4B in the example in FIG. 12. The control unit 51 determines whether the thermo-ON time of the identified indoor unit 4 is within the prediction period (step S36).

When the thermo-ON time is within the prediction period of the identified indoor unit 4 (step S36: YES), the control unit 51 sets the stored thermo-OFF time to the next prediction start time (step S37). The control unit 51 returns to the processing at step S12 illustrated in FIG. 13 to acquire a next prediction result from the second predicting unit 22.

When the thermo-ON time of the identified indoor unit 4 is not within the prediction period (step S36: NO), the control unit ends the processing operation illustrated in FIG. 14.

Figure 15:
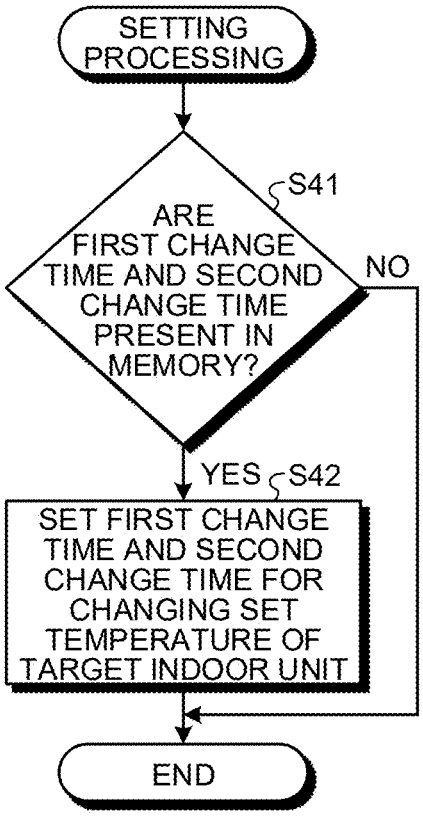
FIG. 15 is a flowchart illustrating an example of processing operation of the centralized controller relating to control processing.

FIG. 15 is a flowchart illustrating an example of processing operation of the centralized controller 5 relating to setting processing. The setting processing is processing with respect to the indoor unit 4 (target indoor unit) identified in the processing in FIGS. 13 and 14. The setting unit 52 in the control circuit 5C in the centralized controller 5 illustrated in FIG. 15 determines whether the first change time and the second change time are present in the change target memory 45 in the memory 31 (step S41). When the first change time and the second change time of the indoor unit 4 subject to change are present in the change target memory 45 (step S41: YES), the setting unit 52 sets the first change time and the second change time of changing the set temperature to indoor unit 4 subject to change (step S42). The setting unit 52 then ends the processing operation illustrated in FIG. 15. As a result, in the processing in FIG. 15, when it reaches the set first change time, the set temperature is changed to lower the current set temperature to be lower by −1° C. in the indoor unit 4 subject to change to which the first change time and the second change time are respectively set. Because the indoor unit 4 subject to change is switched to the thermo-ON because of the changed set temperature, the thermo-ON period is advanced so as to overlap with the thermo-ON period of the reference indoor unit. When it reaches the set second change time, the indoor unit 4 subject to change returns the set temperature after the change back to the original set temperature before the change.

Furthermore, when the first change time and the second change time are not present in the change target memory 45 (step S41: NO), the setting unit 52 ends the processing operation illustrated in FIG. 15.

The server device 6 in the air conditioning system 1 of the first embodiment predicts room temperature of an air-conditioned space in which the multiple indoor units 4 are installed using multiple operation state amounts relating to air conditioning operation. The server device 6 predicts the thermo-ON time and the thermo-OFF time of the respective indoor units 4 among the multiple indoor units 4 using the predicted room temperature and the set temperature, which is a target value of air conditioning. The centralized controller 5 reduces the number of times of stopping and restarting of the compressor 3A1 according to the thermo-ON time and the thermo-OFF time of the respective indoor units 4 using a prediction result of the thermo-ON time and the thermo-OFF time of the respective indoor units 4. As a result, by reducing the number of times of stopping and restarting of the compressor 3A1, it is possible to ensure user comfort while suppressing power consumption associated with air conditioning operation.

The control unit 51 changes the set temperature of the respective indoor units 4 such that the thermo-ON periods of the two or more indoor units 4 overlap with each other among the multiple indoor units 4 by using the prediction result of the second predicting unit 22. As a result, by reducing the number of times of stopping and restarting of the compressor 3A1 by overlapping the thermo-ON periods of the two or more indoor units 4, it is possible to ensure user comfort while suppressing power consumption associated with air conditioning operation.

The control unit 51 predicts the number of times of stopping and restarting of the compressor 3A1 within a predetermined period using the prediction result of the second predicting unit 22, and identifies the indoor unit 4 that is predicted to be the last one to be switched to the thermo-OFF within the predetermined period as the reference indoor unit. The control unit 51 changes the set temperature of the other indoor unit 4 such that the thermo-ON time of the indoor unit 4 other than the reference indoor unit and the thermo-ON period of the reference indoor unit overlap with each other. As a result, by reducing the number of times of stopping and restarting of the compressor 3A1 by overlapping the thermo-ON periods of the two or more indoor units 4, it is possible to ensure user comfort while suppressing power consumption associated with air conditioning operation.

Although a case in which the set temperature of the indoor unit 4 subject to change is changed, for example, in 1° C. units as a predetermined temperature unit, it is not limited thereto and may be changed as appropriate.

A case has been explained in which the control unit 51 determines the indoor unit 4 corresponding to the first thermo-ON time out of the other indoor units 4 as the indoor unit 4 subject to setting change so that the thermo-ON time of the indoor unit 4 other than the reference indoor unit overlaps with the thermo-ON period of the reference indoor unit. However, the number of the indoor unit 4 subject to setting change is not limited to be one, and may be changed as appropriate.

Moreover, a case has been explained in which the centralized controller 5 in the air conditioning system 1 according to the first embodiment acquires a prediction result of the thermo-ON time and the thermo-OFF time of the respective indoor units 4 from the control circuit 6C in the server device 6, and performs control processing based on the prediction result. However, the first predicting unit 21 and the second predicting unit 22 may be arranged in the centralized controller, and such an embodiment will be explained as a second embodiment in the following.

Second Embodiment

Configuration of Air Conditioning Apparatus

Figure 16:
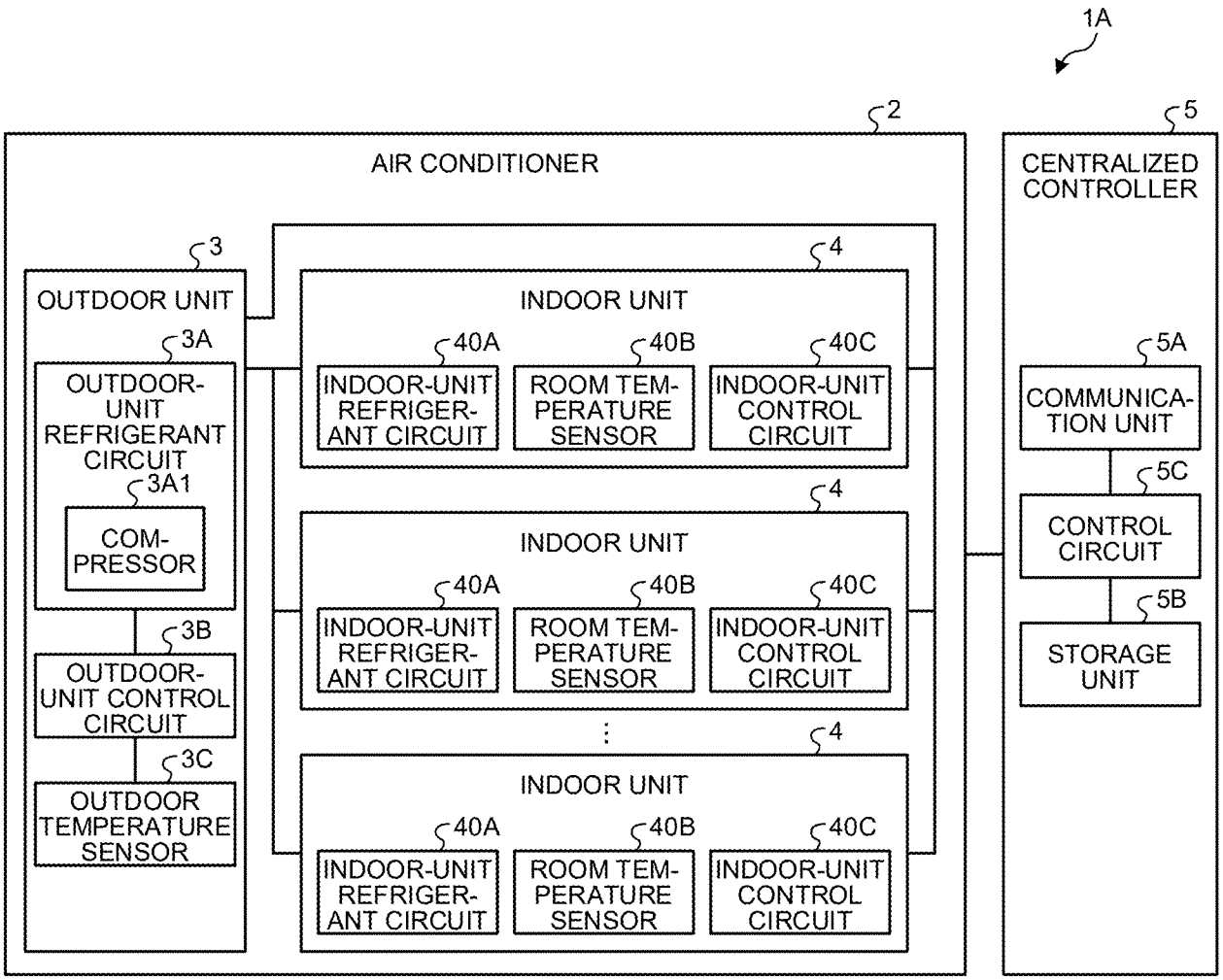
FIG. 16 is an explanatory diagram illustrating an example of a configuration of an air conditioning apparatus according to a second embodiment.
Figure 17:
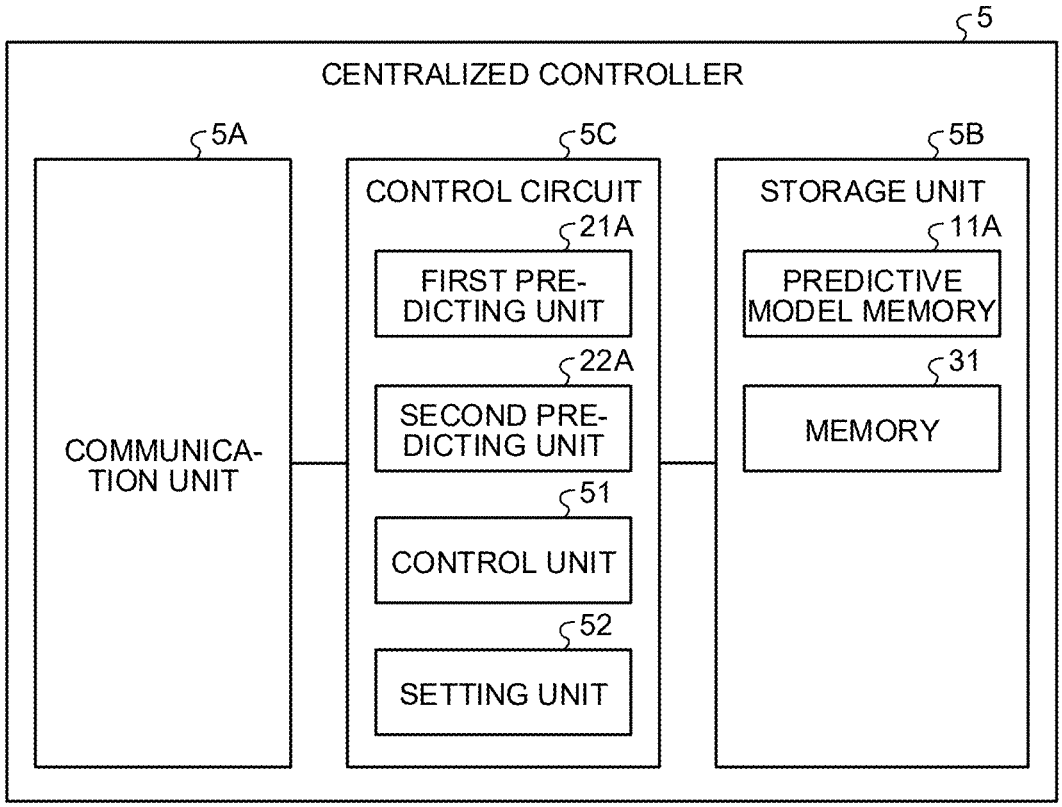
FIG. 17 is a block diagram illustrating an example of a configuration of the centralized controller.

FIG. 16 is an explanatory diagram illustrating an example of a configuration of an air conditioning apparatus 1A according to the second embodiment. By assigning identical reference signs to identical components to those of the air conditioning system 1 according to the first embodiment, explanation of duplicated components and operations will be omitted. The air conditioning apparatus 1A illustrated in FIG. 16 includes the air conditioner 2 and the centralized controller 5. The server device 6 is not included. FIG. 17 is a block diagram illustrating an example of a configuration of the centralized controller 5. A storage unit 5B in the centralized controller 5 illustrated in FIG. 17 includes a predictive model memory 11A that stores a predictive model. The predictive model includes the thermo-OFF predictive model and the thermo-ON predictive model.

Furthermore, the control circuit 5C includes a first predicting unit 21A and a second predicting unit 22A other than the control unit 51 and the setting unit 52.

The first predicting unit 21A predicts room temperature of an air-conditioned space in which the multiple indoor units 4 are installed, for example, the respective room temperature in 30 minutes from a point of time of prediction at prediction timings of every 30 minutes by using the predictive model using multiple operation state amounts relating to air conditioning operation.

The second predicting unit 22A predicts the thermo-ON time and the thermo-OFF time of the respective indoor units 4 using the room temperature of the respective indoor units 4 predicted by the first predicting unit 21A and a set temperature that is a target value of air conditioning operation. The control unit 51 reduces the number of times of stopping and restarting of the compressor 3A1 in the outdoor-unit refrigerant circuit 3A according to the thermo-ON or the thermo-OFF time of the respective indoor units 4 using the prediction result of the second predicting unit 22A. The method of reducing the number of times of stopping and restarting the compressor 3A1 is achieved by changing the set temperature of the respective indoor units 4 in a predetermined temperature unit such that the thermo-ON period of the two or more indoor units 4 among the multiple indoor units 4 overlap with each other.

The control unit 51 predicts the number of times of stopping and restarting of the compressor 3A1 in a predetermined period of, for example, 30 minutes from the prediction start time using the prediction result of the second predicting unit 22A. Furthermore, the control unit 51 identifies the indoor unit 4 that is predicted to be the last one to be switched to the thermo-OFF in the predetermined period as the reference indoor unit. Furthermore, the setting unit 52 changes the set temperature of the other indoor unit 4 subject to change in a predetermined temperature unit such that the thermo-ON period of the indoor unit 4 other than the reference indoor unit overlaps with the thermo-ON period of the reference indoor unit.

When the set temperature of the indoor unit 4 has been change by the setting unit 52, the first predicting unit 21A re-predicts the room temperature of the indoor space of the respective indoor units 4 based on the set temperature after the change. The second predicting unit 22A re-predicts the thermo-ON time and the thermo-OFF time of the respective indoor units 4 using the room temperature predicted by the first predicting unit 21A and the set temperature that is a target temperature of air conditioning operation. The control unit 51 controls the indoor unit 4 using the re-prediction result of the second predicting unit 22A.

Operation of Air Conditioning Apparatus

Figure 18:
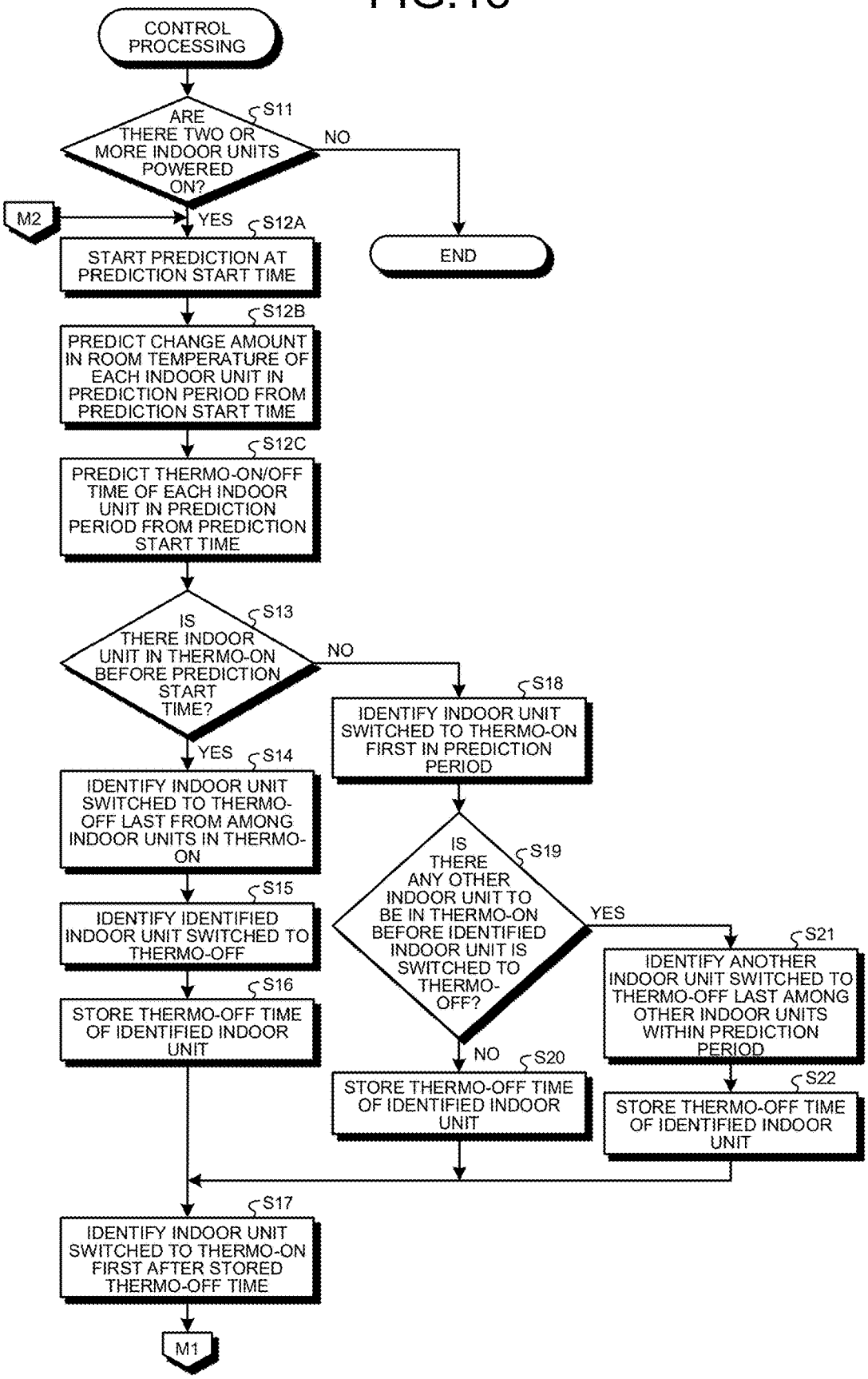
FIG. 18 is a flowchart illustrating an example of processing operation of the centralized controller relating to control processing.

FIG. 18 is a flowchart illustrating an example of processing operation of the centralized controller 5 relating to control processing. The control processing is started at prediction timings of every 30 minutes. As illustrated in FIG. 18, the control unit 51 in the centralized controller 5 determines whether there are two or more of the indoor units 4 powered ON (step S11). When there are two or more of the indoor units 4 powered ON (step S11: YES), prediction is started at the prediction start time (step S12A).

The first predicting unit 21A predicts a room temperature change amount of the respective indoor units 4 in a predetermined period from the prediction start time, for example, in 30 minutes, as illustrated in FIG. 6 (step S12B). The second predicting unit 22A predicts the thermo-ON/thermo-OFF time of the respective indoor units 4 during the prediction period from the prediction start time as illustrated in FIG. 7 (step S12C). The control unit 51 shifts to processing at step S13 to determine whether there is the indoor unit 4 that is in the thermo-ON within the prediction period. Because the operation at step S13 and later is the same processing as processing at step S13 and later, duplicated explanation of processing will be omitted.

The centralized controller 5 according to the second embodiment predicts the room temperature in the air-conditioned space in which the multiple indoor units 4 are installed using multiple operation state amounts relating to air conditioning operation. The centralized controller 5 predicts the thermo-ON time and the thermo-OFF time of the respective indoor units 4 out of the multiple indoor units 4 using the room temperature predicted by the first predicting unit 21A and the set temperature that is a target value of air conditioning. Furthermore, the centralized controller 5 reduces the number of times of stopping and restarting of the compressor 3A1 according to the thermo-ON time or the thermo-OFF time of the respective indoor units 4 using the prediction result of the thermo-ON time and the thermo-OFF time of the respective indoor units 4. As a result, by reducing the number of times of stopping and restarting of the compressor 3A1, it is possible to ensure user comfort while suppressing power consumption associated with air conditioning operation.

For convenience of explanation, a case has been explained in which the set temperature of the indoor unit 4 is changed such that the thermo-ON period of at least one of the indoor units 4 among the multiple indoor units 4 overlaps with the thermo-ON period of the reference indoor unit. However, it is not necessary to change the setting temperature of all of the indoor units 4, and it may be changed as appropriate.

Moreover, respective components of the respective parts illustrated are not necessarily required to be configured physically as illustrated. That is, specific forms of distribution and integration of the respective parts are not limited to the ones illustrated, and all or some thereof can be configured to be distributed or integrated functionally or physically in arbitrary units according to various kinds of loads, usage conditions, and the like.

Furthermore, as for the respective processing functions performed by the respective devices, all or some arbitrary part thereof can be implemented on a central processing unit (CPU) (or a microcomputer, such as a micro-processing unit (MPU)) and micro controller unit (MCU)). Moreover, needless to say that the all or some arbitrary part of the respective processing functions may be performed on a program analyzed and executed by a CPU (or a microcomputer, such as MPU and MCU) or on hardware by wired logic.

REFERENCE SIGNS LIST

1 AIR CONDITIONING SYSTEM
1A AIR CONDITIONING APPARATUS
2 AIR CONDITIONER
3 OUTDOOR UNIT
3A1 COMPRESSOR
4 INDOOR UNIT
5 CENTRALIZED CONTROLLER
5C CONTROL CIRCUIT
6 SERVER DEVICE
6C CONTROL CIRCUIT
21, 21A FIRST PREDICTING UNIT
22, 22A SECOND PREDICTING UNIT
51 CONTROL UNIT
52 SETTING UNIT

The invention claimed is:

1. An air conditioning system comprising:

an outdoor unit that includes a compressor;

a plurality of indoor units that are connected to the outdoor unit through a refrigerant pipe;

a control device configured to control the outdoor unit and the indoor units; and a server device that is capable of communicating with the control device, wherein the server device includes processing circuitry configured to:

predict, as a first predicting, room temperature of an air-conditioned space in which the indoor units are installed, by using a plurality of operation state amounts relating to air conditioning operation;

predict, as a second predicting, a point of time when each indoor unit out of the indoor units is switched to thermo-ON and a point of time when it is switched to thermo-OFF, by using the room temperature predicted by the first predicting and set a temperature that is a target temperature of the air conditioning operation, and the control device includes a controller configured to change the set temperature of each of the indoor units such that the periods of time when at least two of the indoor units out of the indoor units are switched to the thermo-ON overlap with each other according to the point of time when each of the indoor unit is switched to the thermo-ON or the thermo-OFF, by using a prediction result of the second predicting, and control driving of the compressor.

2. The air conditioning system according to claim 1, wherein the controller is configured to control driving of the compressor such that a number of times of stopping and restarting of driving of the compressor is reduced comparing to the number of times before using the prediction result of the second predicting, by using the prediction result of the second predicting.

3. The air conditioning system according to claim 1, wherein the controller is configured to predict the number of times of stopping and restarting of driving of the compressor within a predetermined period by using the prediction result of the second predicting, identify the indoor unit that is predicted to be a last one to be switched to the thermo-OFF within the predetermined period as a reference indoor unit, and change the set temperature of the indoor unit other than the reference indoor unit such that a period of time when the other indoor unit is in the thermo-ON overlaps with a period of time when the reference indoor unit is in the thermo-ON.

4. The air conditioning system according to claim 3, wherein the controller is configured to change the set temperature of the indoor unit in a predetermined temperature unit.

5. The air conditioning system according to claim 3, wherein the first predicting includes predicting, when the set temperature of the indoor unit is changed by the controller, room temperature of indoor space of each of the indoor unit based on the set temperature after the change, the second predicting includes predicting a point of time when each of the indoor unit is switched to the thermo-ON and a point of time when it is switched to the thermo-OFF by using the room temperature predicted by the first predicting and the set temperature that is a target value of the air conditioning operation, and the controller is configured to control driving of the compressor by using a prediction result of the second predicting.

6. The air conditioning system according to claim 1, wherein the first predicting includes predicting the room temperature by selecting an operation state amount to be used for prediction from among the operation state amounts, and performing regression analysis.

7. The air conditioning system according to claim 6, wherein the operation state amount used for the prediction includes at least the set temperature, the room temperature, and outdoor air temperature.

8. The air conditioning system according to claim 1, wherein the first predicting includes predicting, when the set temperature of the indoor unit is changed by the controller, room temperature of indoor space of each of the indoor unit based on the set temperature after the change, the second predicting includes predicting a point of time when each of the indoor unit is switched to the thermo-ON and a point of time when it is switched to the thermo-OFF by using the room temperature predicted by the first predicting and the set temperature that is a target value of the air conditioning operation, and the controller is configured to control driving of the compressor by using a prediction result of the second predicting.

9. An air conditioning apparatus comprising:

an outdoor unit that includes a compressor;

a plurality of indoor units that are connected to the outdoor unit through a refrigerant pipe; and a control device configured to control the outdoor unit and the indoor units, wherein the control device includes a controller configured to:

predict, as a first predicting, room temperature of an air-conditioned space in which the indoor units are installed, by using a plurality of operation state amounts relating to air conditioning operation; and predict, as a second predicting, a point of time when each indoor unit out of the indoor units is switched to thermo-ON and a point of time when it is switched to thermo-OFF, by using the room temperature predicted by the first predicting and a set temperature that is a target temperature of the air conditioning operation;

change the set temperature of each of the indoor units such that the periods of time when at least two of the indoor units out of the indoor units are switched to the thermo-ON overlap with each other according to the point of time when each of the indoor unit is switched to the thermo-ON or the thermo-OFF, by using a prediction result of the second predicting; and control driving of the compressor.

10. The air conditioning apparatus according to claim 9, wherein the controller is configured to control driving of the compressor such that a number of times of stopping and restarting of driving of the compressor is reduced comparing to the number of times before using the prediction result of the second predicting, by using the prediction result of the second predicting.

11. The air conditioning apparatus according to claim 9, wherein the controller is configured to predict the number of times of stopping and restarting of driving of the compressor within a predetermined period by using the prediction result of the second predicting, identify the indoor unit that is predicted to be a last one to be switched to the thermo-OFF within the predetermined period as a reference indoor unit, and change the set temperature of the indoor unit other than the reference indoor unit such that a period of time when the other indoor unit is in the thermo-ON overlaps with a period of time when the reference indoor unit is in the thermo-ON.

12. The air conditioning apparatus according to claim 11, wherein the controller is configured to change the set temperature of the indoor unit in a predetermined temperature unit.

13. The air conditioning apparatus according to claim 11, wherein the first predicting includes predicting, when the set temperature of the indoor unit is changed by the controller, room temperature of indoor space of each of the indoor unit based on the set temperature after the change, the second predicting includes predicting a point of time when each of the indoor unit is switched to the thermo-ON and a point of time when it is switched to the thermo-OFF by using the room temperature predicted by the first predicting and the set temperature that is a target value of the air conditioning operation, and the controller is configured to control driving of the compressor by using a prediction result of the second predicting.

14. The air conditioning apparatus according to claim 9, wherein the first predicting includes predicting the room temperature by selecting an operation state amount to be used for prediction from among the operation state amounts, and performing regression analysis.

15. The air conditioning apparatus according to claim 14, wherein the operation state amount used for the prediction includes at least the set temperature, the room temperature, and outdoor air temperature.

16. The air conditioning apparatus according to claim 9, wherein the first predicting includes predicting, when the set temperature of the indoor unit is changed by the controller, room temperature of indoor space of each of the indoor unit based on the set temperature after the change, the second predicting includes predicting a point of time when each of the indoor unit is switched to the thermo-ON and a point of time when it is switched to the thermo-OFF by using the room temperature predicted by the first predicting and the set temperature that is a target value of the air conditioning operation, and the controller is configured to control driving of the compressor by using a prediction result of the second predicting.

17. A control method of an air conditioning apparatus that includes an outdoor unit including a compressor, a plurality of indoor units that are connected to the outdoor unit through a refrigerant pipe, to control driving of the compressor, the method comprising:

predicting room temperature of an air-conditioned space in which the indoor units are installed, by using a plurality of operation state amounts relating to air conditioning operation;

predicting a point of time when each indoor unit out of the indoor units is switched to thermo-ON and a point of time when it is switched to thermo-OFF, by using the predicted room temperature and a set temperature that is a target temperature of the air conditioning operation;

changing the set temperature of each of the indoor units such that the periods of time when at least two of the indoor units out of the indoor units are switched to the thermo-ON overlap with each other according to the point of time when each of the indoor unit is switched to the thermo-ON or the thermo-OFF, by using the predicted points of times to be switched to the thermo-ON and the thermo-OFF; and controlling driving of the compressor, by processing circuitry.

* * * * *